US005678812A

United States Patent [19]

Hartsoe

[11] Patent Number: 5,678,812

[45] Date of Patent: Oct. 21, 1997

[54] BINDERY APPARATUS WITH GATHERING CONVEYORS AND A METHOD OF MAKE-READY

[75] Inventor: Allen Hartsoe, Maiden, N.C.

[73] Assignee: R. R. Donnelley & Sons Company, Lisle, Ill.

[21] Appl. No.: 599,978

[22] Filed: Feb. 14, 1996

[51] Int. Cl.[6] ..... B65H 39/00

[52] U.S. Cl. ..... 270/52.16; 270/52.18; 270/52.29

[58] Field of Search ..... 270/52.14, 52.16, 270/52.18, 52.26, 52.29

[56] References Cited

U.S. PATENT DOCUMENTS

| | | | |
|---|---|---|---|
| 1,791,081 | 2/1931 | Seiter | 270/52.18 X |
| 3,664,655 | 5/1972 | McCain et al. | 270/52.18 X |
| 4,083,551 | 4/1978 | Denis | 270/52.18 |
| 5,346,196 | 9/1994 | Nussbaum et al. | 270/52.14 |
| 5,435,534 | 7/1995 | Linkowski et al. | 270/52.14 X |

*Primary Examiner*—Hoang Nguyen
*Attorney, Agent, or Firm*—Fitch, Even, Tabin & Flannery

[57] ABSTRACT

A bindery apparatus and method are disclosed for supporting, conveying and collating signatures received from pocket feeding stations. The signatures are conveyed by conveyors having a projection. Indicia on scales related to the size of signature are provided. When changing from one size of the signature to another size of signature, the common drive for the signatures is stopped at a reference point, e.g., 100°, and then the conveyor lugs on the gathering conveyor and the second coveyor are repositioned to be at the signature size indicia on its associated scale. Then, the gathering conveyor and second conveyor are reconnected to the common drive. The preferred system includes a transfer conveyor with a lug for pushing collated signatures through a fixing station where they are stitched or glued together, and then delivered to the second conveyor. An indicia scale is associated with the transfer conveyor, and its lug is set at the indicia for size of signature when the transfer conveyor is disconnected at the reference position. The scale settings for the respective conveyors may be kept in a job file or history and by using this data, the conveyors may be repositioned to the settings used previously for this job. This reduces considerably the make-ready time and waste associated therewith.

15 Claims, 26 Drawing Sheets

*Fig. 12a*

67

| POCKET POSITION | 1 | 2 | 3 | 4 | 5 | 6 | 7 | 8 | 9 | 10 | 11 | 12 |
|---|---|---|---|---|---|---|---|---|---|---|---|---|
| POCKET TYPE | | 279 | 279 | 279 | 279 | 279 | 279 | 279 | 279 | | | |
| COMPONENT DESCRIPTION | | 5370 FREE | 5371 10% | 5372 PEEK | 5373 B | 5371 | 5366 T | 5365 T | 5371 INSERT | | | |
| NO. OF PAGES | | | | | | | | | | | | |
| BAR | | 10 1/2 | 10 1/2 | 10 1/2 | 10 1/2 | 10 1/2 | 10 1/2 | 10 1/2 | 10 1/8 | | | |
| POST | | 4 1/8 | 4 1/8 | 4 1/8 | 4 1/8 | 4 1/8 | 4 1/8 | 4 1/8 | 4 1/8 | | | |
| BACKPLATE | | 10 1/2 | 10 1/2 | 10 1/2 | 10 1/2 | 10 1/2 | 10 1/2 | 10 1/2 | 10 1/8 | | | |
| SUCKER TYPE (FEEDER) | | | | | | | | | | | | |
| STOPS | | 210MM | 210MM | 210MM | 210MM | 210MM | 210MM | 210MM | 210MM | | | |
| CAMS | | 50 | 50 | 50 | 50 | 50 | 50 | 50 | 50 | | | |
| SIG OPENING *FRONT* | | | | | | | | | | | | |
| GRIPPER TYPE | | | | | | | | | | | | |
| VACCUM ADJUSTMENT | | | | | | | | | | | | |
| VACCUM STEMS | | | | | | | | | | | | |
| SUCKER TYPE | | | | | | | | | | | | |
| SIG OPENING *BACK* | | | | | | | | | | | | |
| GRIPPER TYPE | | | | | | | | | | | | |
| VACCUM ADJUSTMENT | | | | | | | | | | | | |
| SUCKER TYPE | | | | | | | | | | | | |
| DROP | | 3 7/16 | 10 | 17 1/16 | 1/4" | 7 1/4 | 6 1/8 | 18 9/16 | 7/8" | | | |
| | | | | | | | | | | | | |

| CHAINS | | STITCHES | | TRIMMER | | | | JOB NAME POPCORN | DATE RECORDED 1/1/95 |
|---|---|---|---|---|---|---|---|---|---|
| 90 DEGREE | 10 1/2 | FIRST | 3 | HEAD/FOOT | 10 | PUNCH | | | |
| TRANSFER | 10 1/2 | SECOND | 0 | FACE | 7 3/8 | KNIVES | | JOB NUMBER 71764 | MACHINE # 27 |
| GATHERING | 10 1/2 | THIRD | 3 | BELT | 16-JAN | SUPPORT | | | |
| | | FORTH | | DRIVE | | ROLLER | | | MACHINE SPEED 10,200 |
| | | | | | | | | | |
| | | PROBLEM | | | | | | | |
| STACKER | | | | | | | | | |
| TYPE | | SOLUTION | | | | | | | |
| BUCK WIDTH | | | | | | | | | |
| BUCK LENGTH | | PROBLEM | | | | | | | |
| SIDE JOG | | | | | | | | | |
| STACK SP. | | SOLUTION | | | | | | | |
| | | | | | | | | | |

*Fig. 12b*

BINDERY APPARATUS WITH GATHERING CONVEYORS AND A METHOD OF MAKE-READY

FIELD OF THE INVENTION

This invention relates to bindery apparatus having gathering conveyors for collating sheets to be bound together and more particularly, to an improved make-ready or set up of the gathering conveyors to obtain production run speeds of operation.

BACKGROUND OF THE INVENTION

The invention relates to bindery apparatus that has a large number of signature feeding machines (hereinafter called "pocket machines") which feed individual folded sheets or signatures to a gathering conveyor. The gathering conveyor passes beneath the pocket machines and collects the signatures and receives a systematic superimposition of sheets from the respective pocket machines to create a multi-signature book form. The book form is conveyed on the saddle by a second conveyor into and through a station where ends of the signatures are secured together by stitches or adhesives.

The present invention will be described hereinafter in connection with the preferred embodiment of the invention which is a bindery apparatus that has a slide surface in the form of a saddle for the signatures. The saddle is in the form of an inverted "V". The saddle receives opened, V-shaped signatures and collates them; and the gathering conveyors carry the book forms to a trimmer which severs a face, head and foot of the book form. This saddle bindery apparatus operates at very high speeds, e.g., 5,000 to 18,000 book forms per hour. Typically, the size of the signature varies from one job to the next job so that the pocket feeders, conveyors and trimmer must be adjusted. These adjustments usually result in a long period of make-ready time and tweaking of the apparatus until a final, full production run at high speed is maintained continuously in order to run a job, which is often several hundred thousand book forms. While the present invention is described in connection with the make-ready of a saddle bindery apparatus, it is also applicable to a so-called "perfect" bindery apparatus where the slide surface is a generally horizontal, flat surface, which is inclined e.g., 15° to a horizontal, plane and the folded sheet signatures lie flat on the flat slide surface. The perfect bindery apparatus has upstanding members or projections, often called "pins" on its gathering conveyors which travel beneath the pocket machines and which push the collated signatures, collected into a book form, into a station where the ends of the signatures are secured together usually with an adhesive. The folded ends of the collated signatures are severed, and the adhesive is applied to the severed ends to secure them together. The perfect bindery apparatus generally operates at slower speeds, has shorter production runs, and requires less make-ready time than does the saddle bindery apparatus, where the higher speed handling of signatures and book forms causes a need for more precise control of the signatures and the apparatus handling the signatures.

As stated above, saddle binding apparatus operates at very high production speeds, e.g., 5,000 to 18,000 book forms per hour with the signatures and book forms continuously traveling at high speeds. The number of signatures in a book form varies from a few to a large number—e.g., eighteen (18) signatures or more. Likewise, the number of pages in one signature varies from one to several pages. The size dimensions of the signatures varies from job to job, and the conveyors pushing signatures and book forms along the saddle must be properly timed when changing from one size of signature to another size of signature. Currently, the operators of such bindery apparatus are skilled persons who have been trained over an extensive period of time of how to make ready the bindery apparatus for a particular job and then to do initial production runs which require fine adjustments or tweaking of the machines and conveyors to obtain the full production rate of operation of the bindery apparatus. The time used for make-ready and for initial production tweaking is currently very substantial. For example, a typical make-ready operation may take four to twelve (12) or more hours, and the initial production runs with tweaking may last one to twenty-four (24) hours before full production speed is obtained. During the make-ready and initial production runs, the bindery apparatus is run with signatures many of which become scrap. It is not uncommon for as much as one-half of one percent of a production run to become scrap during the make-ready and initial production runs.

If a bindery apparatus is not making a production run, it is not making signature book forms; so that a make-ready time of twelve (12) hours will mean twelve (12) hours of lost production. If the production rate is 10,000 book forms per hour, then the production of 120,000 book forms is lost during the twelve hours of make-ready. Also, if the scrap generated is 1,000 book forms, by way of example, then the cost of paper and printing is another significant expense.

The make-ready involves the operator or operators properly positioning and feeding of signatures from the pocket machines onto the gathering conveyor in precisely timed relationship to a gathering lug on the gathering conveyor at each of the active pocket machines. This timely transfer of signatures from a stationary stack in a pocket machine onto the saddle in front of a conveyor lug is often called the "drop" of a signature.

The timing of the drop is often a most time-consuming task in that the rotary grippers that receive a signature from the pocket suction feeders must reorient the signature open it and deposit it precisely in front of the gathering chain lug. If the signature hits on top of the traveling lug, a misfeeding will occur. Likewise, the depositing of a signature with a large space between it and a traveling lug is undesirable. The timing of the drop involves the use of upper and lower gripper drums that grip the ends of the folded sheet and spread the signature and deposit it with laps on opposite sides of the saddle precisely in front of a lug or pusher on a gathering chain. The lower gripper drum has a rotatable cam that allows shifting of its brush bar to different positions depending on the size of the signature and the upper drum feeds the fold of the signature to abut a stop. There is a scale associated with the stop to assist the operator in positioning the stop at the desired position dependent on the size of the signature.

There may be a very large number of pocket machines, e.g., eighteen (18) machines each depositing signatures in succession, and one on top of the other, at high rates of speed. It only takes one pocket machine to be mistimed in drop, or misaligned in its guiding of signatures to cause a problem and an incorrect feed and drop. Currently, the operator initially uses judgment to set the gripper mechanism relative to gathering chain lug. The operator jogs the machine to test the drop and then makes fine tweaking adjustments of the gripper mechanisms or signature guides or the like until the proper drop is achieved, When an operator is jogging the machine to test a drop at one signature pocket machine, any other operators trying to adjust other pocket machines, conveyors, stitchers or trimmers must remove their hands from the now-moving machine. If there are 18 pocket machines and each is jogged, then a large amount of make-ready time is needed because others must have their hands out of the bindery apparatus for each jogging related to a given pocket machine. If it takes one-half hour per pocket machine to make the pocket machines ready, then nine hours are needed for make-ready of the pocket machines alone. Even after slow speed jogging to time the drop and feeding onto the saddle conveyor, there still are often further adjustments that need to be made when the bindery apparatus is run at higher speeds. At these higher speed initial runs, the drop may vary slightly from the lower speed jogging runs. Tweaking adjustments are then done while the bindery apparatus is shut down, and then a high speed run is made again. Some tweaking adjustments are difficult to make because the pocket machines may deposit and drop correctly most of the time, and then intermittently fail to drop signatures properly. A change from a jogging speed to a high production speed may also reveal that improper timing or alignments have occurred between conveyors, at the stitcher machine, or at the trimmer machine that were not detected or correct during the initial make-ready, as will be explained below.

The downstream conveyors and the stitching and trimming machines also need to be adjusted when changing signature size or from one job to the next. Typically, the trimming machine is located at right angles to the stitching machine and the gathering conveyors. The stitched book forms are delivered to an infeed conveyor for the trimming machines which carry the book forms off at 90° to the saddle and through the trimmer at which head and foot knives trim excess off the edges of the book forms to make them all identical in size with precisely trimmed edges. The stitched books must be timed in their delivery from the saddle to the trimmer infeed conveyor so that the book forms are precisely centered on the infeed conveyor so that equal increments are cut from the head and foot of the book forms. Thus, the second conveyor lug must be timed to center the stitched book form onto the infeed conveyor. This is done by the operator shifting the lugs on the gathering chain conveyor to what is believed to be the right using manually operated conveyor advancement wheel and a sample book form positioned according to sight and then re-engaging the gathering chain conveyor to the power drive for the conveyors.

In the bindery apparatus described herein, there are three gathering chain conveyors which convey the signatures along the saddle. The last conveyor that conveys the book forms through the stitcher machine and delivers them to the trimmer infeed conveyor is called the double lug conveyor because it has double lugs thereon. In this instance, there is an overhead transfer conveyor that transfers the book forms to the double lug conveyor from a single lug gathering conveyor that runs underneath all of the signature pocket machines. The operator will disengage the overhead lugs of the transfer conveyor from the power drive, and using a sample book form will sight where the transfer lug should be relative to the double lug on the double lug conveyor. The operator then re-engages the transfer conveyor to the common power drive for the conveyors.

The operator also has to time the transfer conveyor to the single lug conveyor. The single lug conveyor is disengaged from the conveyor power drive. A book form is sighted at the delivery end of the single lug conveyor and a manual wheel is turned to advance the single lug to where the operator thinks it should be relative to a transfer of a book form from the single lug conveyor to the transfer conveyor. The single lug conveyor is then reconnected to the power drive of the bindery apparatus. The signature drop machines are then timed to the single lugs on the single lug conveyor. The conveyors often are jogged to insure a proper feeding of book forms to the transfer conveyor, and by the transfer conveyor to the double lug conveyor and from the latter to the center of the trimmer infeed conveyor. Such jogging requires others to stop doing their make-ready adjustments. A change or adjustment of one lug on one conveyor may necessitate a change in the position of an adjacent conveyor lugs and so on. Any maladjustments or tweakings to correct maladjustments may become cumulative in their effect and require further adjustment of other machines or equipment. Hence, the troubleshooting may not be a simple task, and tweaking during initial production runs may take one to eight hours before the bindery apparatus is running at full production speed without mishaps.

From the foregoing, it will be seen that there is a need for a new and improved method of make-ready for conveyors used to transport signatures and book forms along a saddle in a bindery system. Among these needs is a substantial reduction in variations due to the subjective judgment of operators, in the time lost in tweaking, and in the scrap generated. Further, there is a need to reduce the make-ready time so that the bindery apparatus is utilized to a greater extent at full production speed than has been done heretofore.

SUMMARY OF THE INVENTION

In accordance with the present invention, there is provided a new and improved bindery apparatus having a collating conveyor and a method which reduces the amount of make-ready time and waste associated with such bindery apparatus. This is achieved by providing objective scales or standards having indicia which allow the setting of the conveyor apparatus to objective standards, thereby eliminating much of the variation which is caused by operator error or variations in operator subjective judgments.

A considerable time saving is achieved because, without all of the currently used jogging, a plurality of pocket machines may be set up and have their drops timed while the other operators are simultaneously setting the timing of the respective conveyors; and apparatus that works on the book forms. This eliminates the usual time delay where, when an operator is jogging for one pocket, requires that all other operators setting up their respective machine, stop their particular adjustments because their hands would be in danger by moving parts of the machine as it is being jogged.

With the present invention, it is possible to lock out the entire bindery apparatus at a reference point and to have a number of people each simultaneously performing a separate set-up of a particular piece of apparatus, such as one or more signature feeders, a stitcher or adhesive station, the gathering chain, the transfer chain, and/or the trimmer knives relative to its infeed conveyor.

Preferably the tasks are divided into relatively equal increments so that by the time that one operator is done, the other operators also should be finishing their tasks. By way of one example only, one job that was estimated to require about twelve (12) hours of make-ready was actually made ready in 43 minutes when using the present invention. In the same job where it was estimated that the initial production runs would require a tweaking over about four hours with approximately 1,000 pieces of scrap being generated, the initial production run was achieved in one hour with only about twenty pieces of scrap. Thus, from this one example it can be seen that there will be very substantial savings in make-ready time and in scrap. The reduction in time for make-ready and the reduction of time used for tweaking in the initial production runs means that the equipment may be run much higher production rates and achieve greater net copies per hour, thereby providing a more efficient bindery apparatus.

As will be explained in greater detail, the use of objective scales and standards allows the reduction of operator error and the time of tweaking so that high accuracy is improved initially. The present invention eliminates much of the subjective variations in make-ready resulting from subjective judgments of various operators.

In accordance with another aspect of the invention, there is provided historical job cards which record the indicia for a particular job being run; so that when the next time the job is being run, a machine can be set up using the same indicia that was used to run the first job. During the first job, there may have been tweaking or slight changes in measurements on the scale, and these would have been recorded on the previous job card or history such that the machine can be set to the final tweaked position, rather than merely the measured position, thereby also saving time.

Of particular importance is the ability to set each of the pocket machines and their drops to a previous time drop setting that was used for the same or similar job so that many of the subtle misalignments or mistimings that necessitated tweaking can be eliminated on a subsequent run of the same job. Even for new jobs, the historical information from other jobs and the use of scales such as for the timing of the drop is available to the operator to shorten the set-up time.

In accordance with another important aspect of the invention, the gathering chain conveyor system for carrying signatures and book forms is set up and timed by measuring a sample signature (or book form) and using the measured size to set the conveyor lugs at indicia related to the measured size dimension while the machine is locked out. Preferably, each of the conveyors movable along the saddle is provided with a scale positioned on or adjacent to the saddle to permit alignment of an associated conveyor lug at a measured size indicia rather than using subjective alignment of lugs as done heretofore. Beginning at the double lug conveyor that carries book forms into and through the stitcher machine and delivers them to the cross feed conveyor at centered positions thereon, a scale is mounted on the saddle adjacent the delivery end of this double lug conveyor. Having measured the size of the book form, the operator will take the edge of a signature against the double lug to create a vertical line extending down to the scale on the saddle with the leading edge of the lug being repositioned at the length, for example, ten (10) inches in this example. The same type of operation is used for the transfer chain in that there is provided a scale on the saddle. The transfer chain, timing scale is positioned adjacent its leading end where the transfer chain lug first receives a book form from the single lug gathering chain conveyor. The leading edge of the transfer lug is repositioned at the measured length, e.g., 10" using a hand wheel and then the transfer conveyor is re-engaged.

A timing scale on the saddle is also provided at the delivery end of the single lug gathering. The single lug conveyor is disconnected from the drive and repositioned by a hand wheel until the leading edge of the single lug is at the measured indicia, e.g., 10", and the conveyor is then re-engaged to the drive. Thus, a measured signature size and a timing scale are provided to time all of the saddle conveyor chains while the apparatus is locked out a predetermined reference point, which is 100° in this instance. Thus, timing is achieved objectively rather than subjectively, and without jogging. Having all of the chains thus set up using a particular scale, including the 90° transfer chain set-up, transfer chain set-up and the gathering chain set. These are all positioned without having to use an eyeball approximation using a half a book form as was used in the conventional make-ready systems.

From the foregoing, it will be seen that much of the make-ready of the gathering chain lugs and book form chain lugs can be accomplished even while there are no signatures available at the feed pockets. Often, in the past, one had to wait for an hour to an hour and one-half for the actual signatures to be brought to each of the signature feed stations before the set-up could be done. By having a job file and job history, and with the machines locked out at a reference point, e.g., 100°, the measured size or historical data is used to time the conveyors without the machine. The timing of the drop may be set by scale indicia using the same settings from a previous job. Thus, the gathering conveyors can be timed and set to size while awaiting delivery of the particular signatures for each of the respective pockets.

BRIEF DESCRIPTION OF THE DRAWINGS

FIG. 12 is an illustration of a job card;

DETAILED DESCRIPTION OF THE PREFERRED EMBODIMENT

Figure 9:
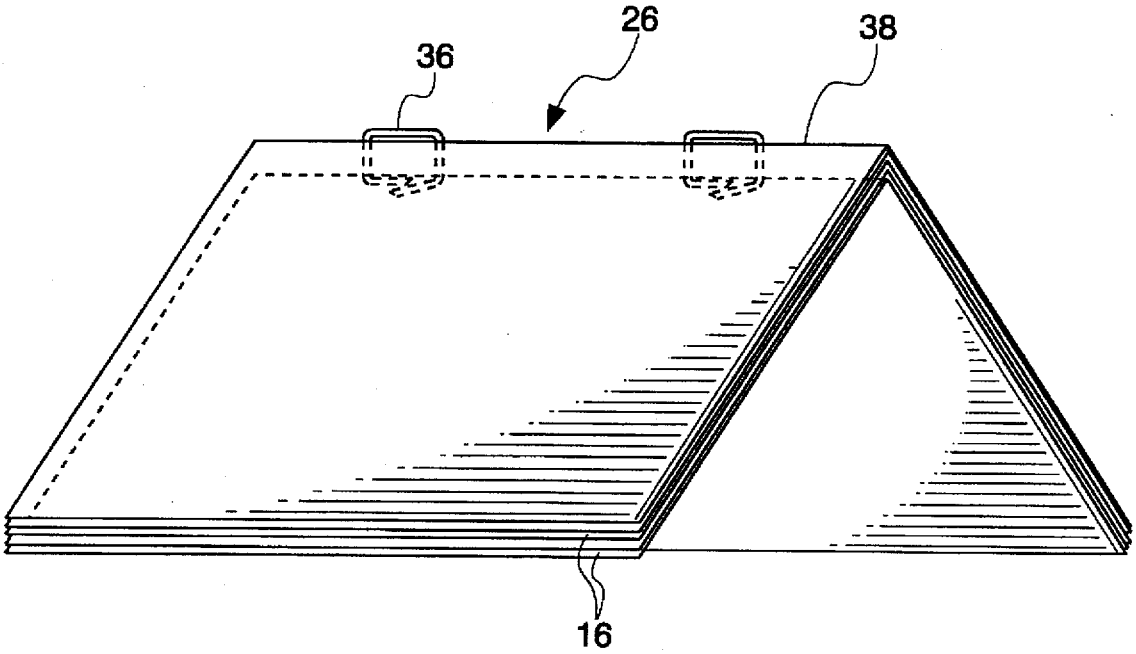
FIG. 9 is a perspective view of a book form.
Figure 24:
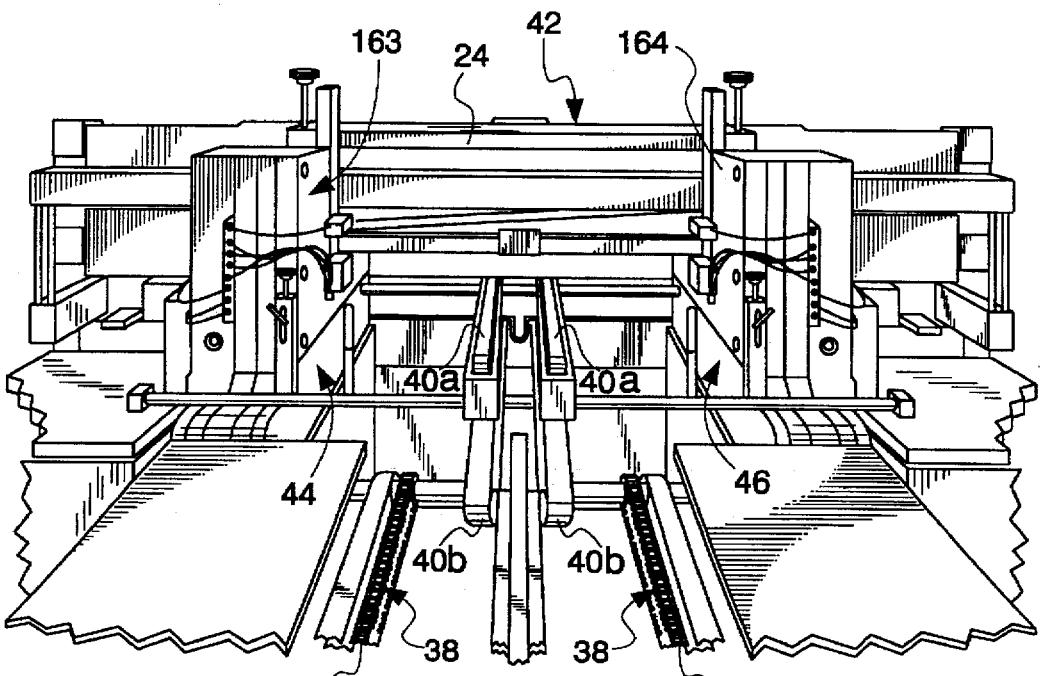
FIG. 24 is an isometric view of a trimmer apparatus constructed in accordance with the preferred embodiment of the invention.

As shown in the drawings for purposes of illustration, the bindery apparatus comprises a plurality of pocket feeders or pocket machines 12, 12*a* each of which has a rotating gripping mechanism 14 which feeds folded signatures 16 from a pocket hopper 18 (FIG. 3) to a saddle 20. The signatures are dropped one on another from the respective pocket machines and thus, are collated as they are conveyed along a saddle 20 by means of a gathering conveyor 22 which preferably has lugs 22*a* to abut the trailing edges of the signatures which are being collated to make a book form 16 (FIG. 9). The book forms are transported to a transfer station 30 at which is located a transfer conveyor 30 which transfers the book forms from the gathering conveyor 22 to a second or double lug gathering chain 32, which carries the book forms through a stitcher station 34 at which stitches or staples 36 are stapled through a fold line 54 for the book forms. The now-stitched book forms leave the saddle 20 after stitching and are conveyed at right angles by a trimmer, infeed conveyor 38 (FIG. 24), at which a pair of upper and lower feed belts 40*a* and 40*b*, move the book forms into a trimmer 42 where they are first stopped and trimmed by head and foot knives 44 and 46 (FIG. 24). After cutting the head and foot of the book forms, the book forms then are conveyed forwardly to stops 50 (FIG. 26) while a face cut knife 52 cuts the rear trailing edges of the book forms.

While only several pocket feeders 12, 12*a* have been shown, it is to be understood that there may be a large number of pocket feeders, for example, 18 such pocket feeders which drop 18 folded signatures, one on top of another, to form a fairly large and thick extensive book form. The thickness of the book form may also be varied because some of the signatures may include several folded sheets so that the number of sheets or signatures in the book form may be larger than 18 sheets in this instance. Heretofore, when setting up a large number of pocket machines the operator would order a skid load of the respective signatures for each one of the pocket machines and have them delivered. Sometimes delivery of such a large number of different signatures to 18 pockets could take as long as an hour to one and one-half hours during which time the signature machines would not be made ready, and no other substantial make-ready operations would have been performed.

Figure 19:
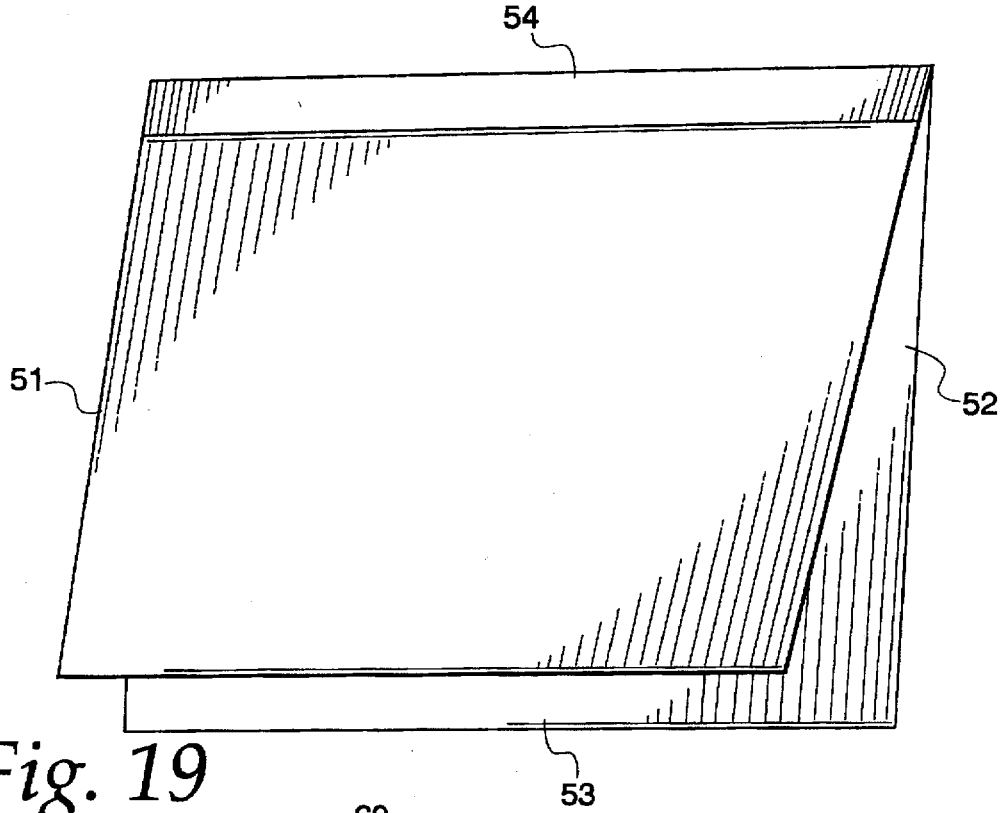
FIG. 19 is a view of a folded signature.

In accordance with the present invention, the make-ready process proceeds whether or not the skid loads of signatures are present. The operator will take a sample signature for each of the pockets and measure it. For example, as best seen in FIG. 19, the length measurement may be from a head side 51 to a foot side 52 which for the example given are described herein in detail is 10". The height dimension is from the face 53 to the fold line or backbone 54 which in this instance could be 8". The signature includes laps or edges which are going to be severed off to leave the book form at its final size after being trimmed by the trimmer.

In the conventional set-up of the pocket machine 12, the operator waited until delivery of actual signatures to the respective signature pockets. Often if there were 18 pockets, it could take as much as one hour to one and one-half hours for the skids to be delivered with the signatures for each of the 18 pockets. Usually, the operator did not set up pockets ahead of time without having an actual signature to be used to set up the pocket. In setting up the pocket with the signature in the conventional machines, the operator folds the signature in half between the head 51 and foot 52, sights this fold on the centerline 60 (FIG. 4B) of the machine hopper, and then adjusts the inner ends 63 of the signature guides, and then adjusts and sights the outer ends 64 of the signature guides 61 and 62 to define the particular amount of bow (FIG. 4B) that is desired for the signatures. If there is an improper amount of bow, the lower ends of the signatures 16 will not stand straight and will be inclined rearwardly (as seen at the righthand portion of the signatures 16 in FIG. 3) wherein there is an improper bow, and the signatures are bent downwardly. An improper bow in one of the 18 signature hoppers can result in an improper feed which will necessitate the stopping of the entire bindery apparatus 10 and the tweaking and the adjustment of the pocket machine to overcome this misalignment. Typically the operator would fold the signature in half and put the signature against the backplate and proceed to go ahead and move inner ends 63 (FIG. 4B) of the left and right side guides 61 and 62 to their respective positions to abut the respective sides of the signature being held by the operator with the signature fold line being at the centerline 60 of the pocket backplate 68 (FIG. 3).

Figure 6:
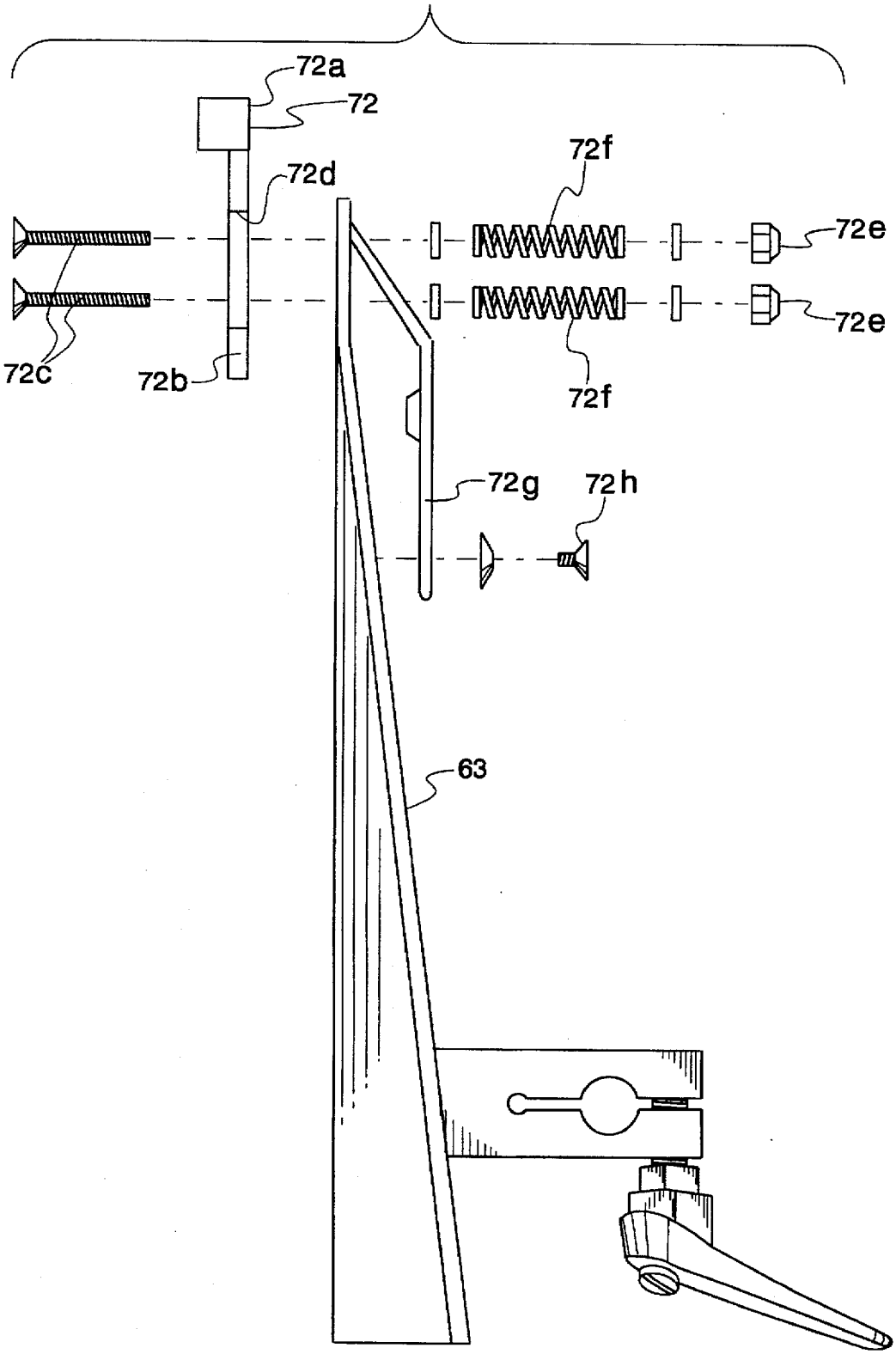
FIG. 6 illustrates the connection of a retractable indicator attached to the front guide.
Figure 7:
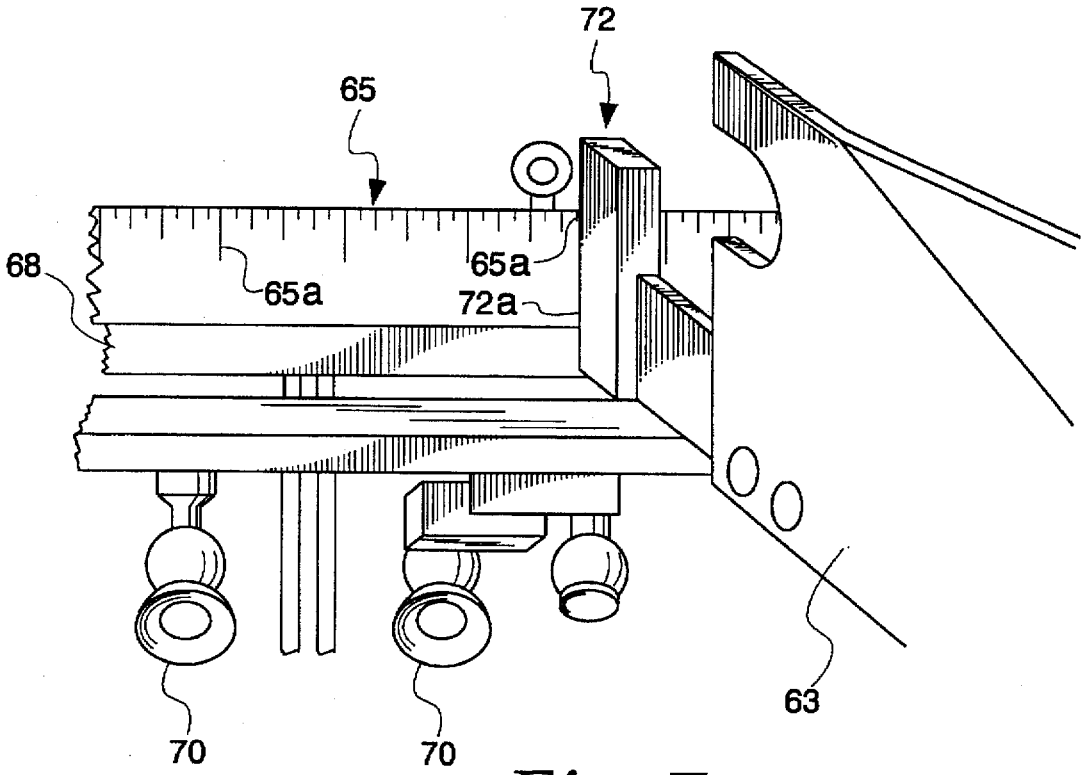
FIG. 7 is an illustration of a retractable indicator and the back plate scale.

In accordance with the present invention, the operator may use historical data collected from a previously-run job and recorded on a job card 67 (FIG. 12) as to what settings the inner ends 63 (FIG. 4B) are to be set when using the scale 65 (FIG. 7) and the signature guide indicators 72 (FIG. 3) which can be moved forwardly from a retracted position to an indicating position shown in FIG. 7 wherein the indicators 72 have a forward edge 72*a* (FIG. 6) positioned adjacent to and indicating an indicia 65*a* (FIG. 7) on the scale 65.

Figure 4:
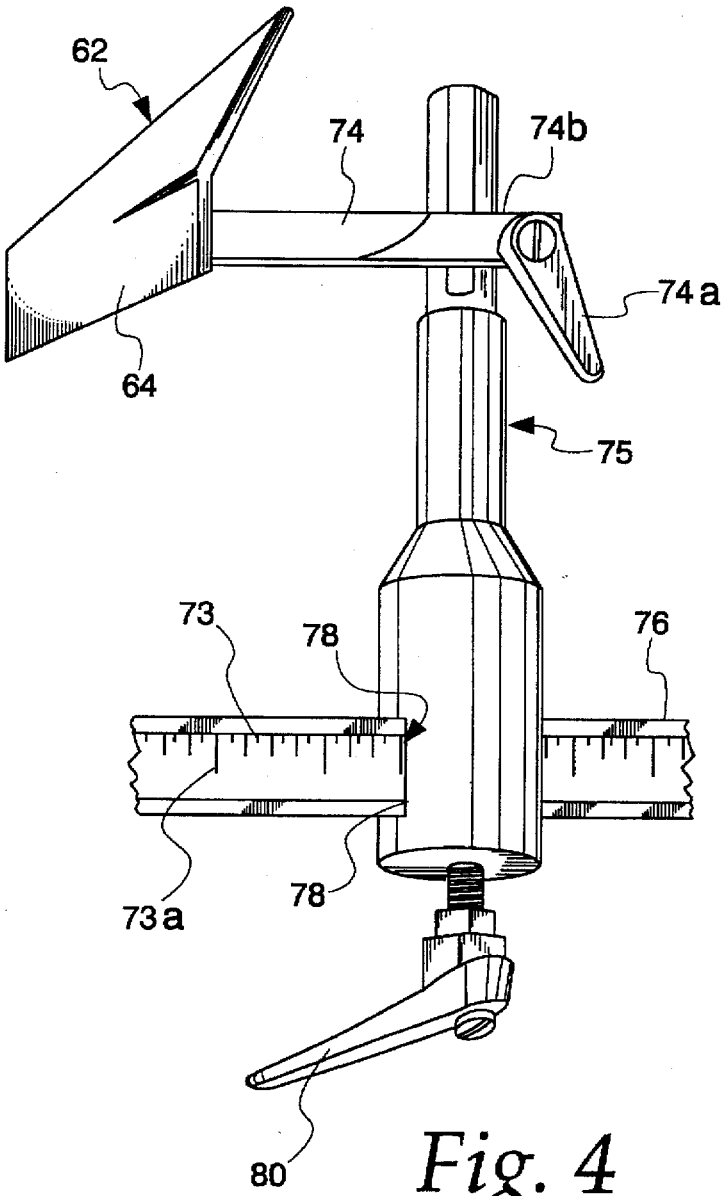
FIG. 4 is an elevational view of pocket bar scale and a pocket post scale, and a signature guide mounted thereon.
Figure 4A:
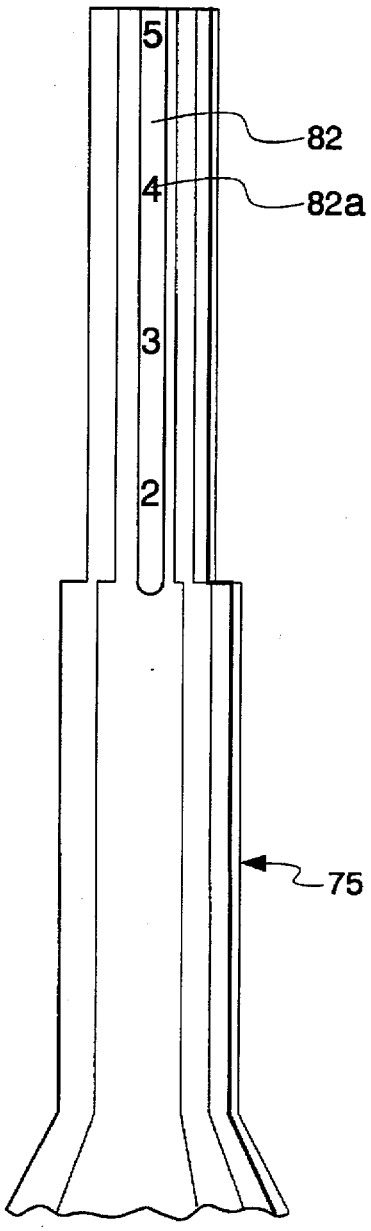
FIG. 4A is a view of the pocket post with the scale thereon.
Figure 4B:
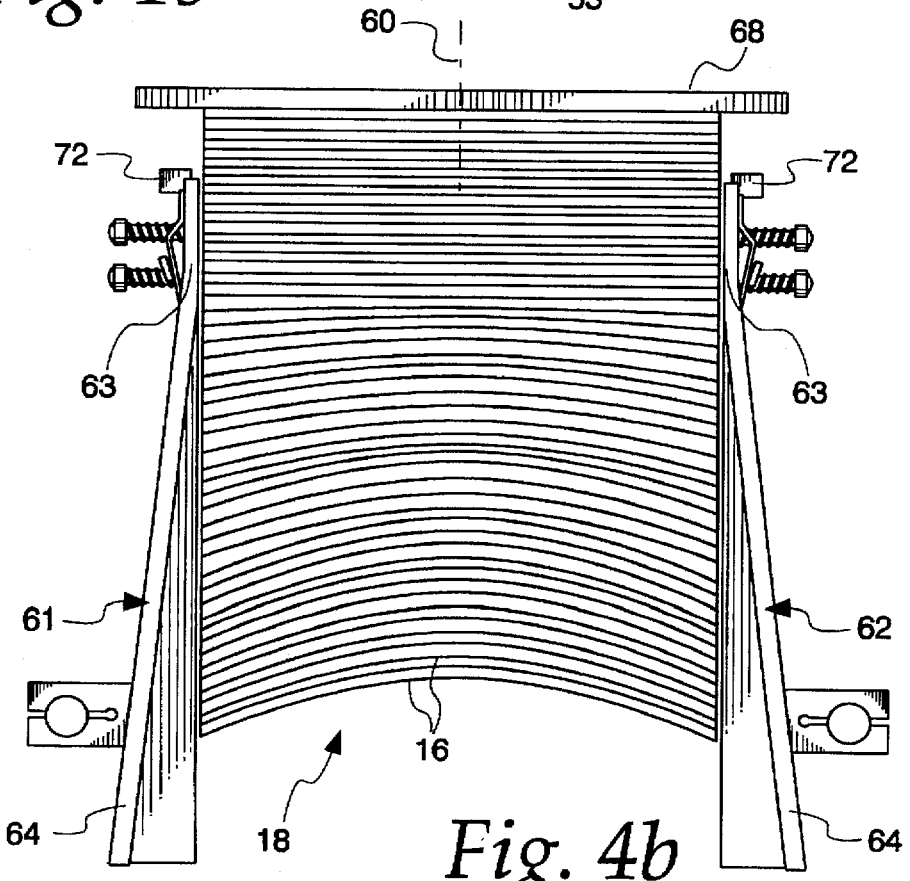
FIG. 4B is a plan view showing a hopper, signatures and signature guides.
Figure 8:
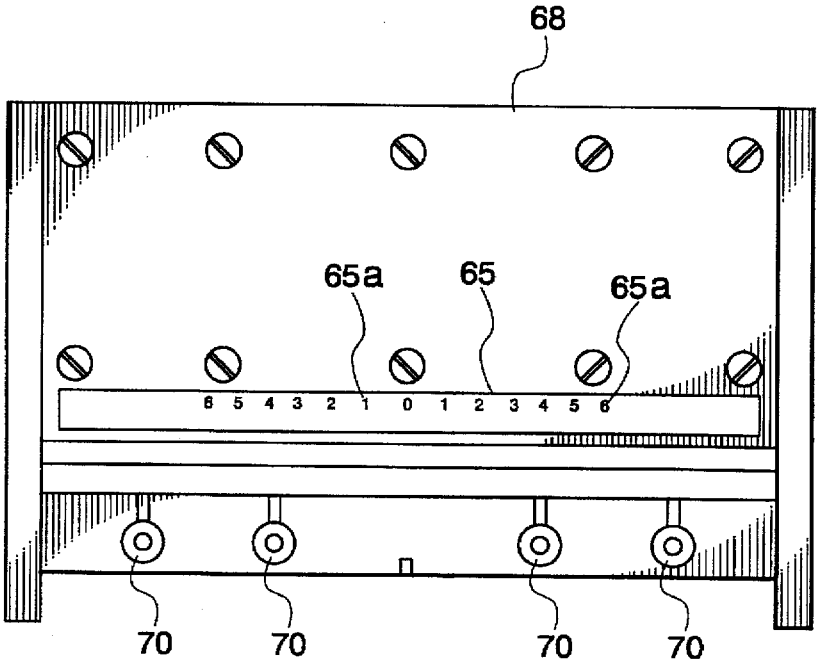
FIG. 8 is a front elevational view showing the pocket backplate scale and suckers showing for removing a signature from the pocket.

In accordance with the present invention, if there is no job card from a previous running of the same job, the length of the signature may be measured without the signature having been present at the machine pocket hopper. Also, the bindery apparatus 10 can be adjusted while it is running another job. That is, if the individual pocket machine 12 (FIG. 17) is idle, the operator may position the side guides 61 and 62 (FIG. 4B) until the indicator edges 72*a* each is aligned with an indicia related to the specific length of the signature. It is preferred that if there is a 10" length for the signature, for example, that an indicia 10 be located by each side guide indicator 72 (FIG. 7). To facilitate such an easy manner of operation, the indicia 65*a* on the scale are actually one-half to scale. For example, an indicia "1" on the scale is actually ½" from the zero (FIG. 8) on the scale 65 rather than 1" from the "0" indicia. Thus, for example, as view in FIG. 8, the distance between "1" on the right and "1" on the left indicia 65*a* is exactly 1" rather than 2". Also, the scales read in opposite directions with the righthand portion of the scale 65 having indicia ascending from left to right; whereas, indicia on the lefthand portion of the scale ascend in the opposite order from right to left. This, of course, allows the operator to merely measure, for example, a 10" width dimension for the signature and adjust both the side guides to the number 10 indicia without having to perform any mathematics or any calculations with respect to the centerline 60 (FIG. 4B). The preferred scale 65 (FIG. 8) is merely a small, thin strip which has been secured to the backplate 68 as by an adhesive or fasteners.

Figure 3:
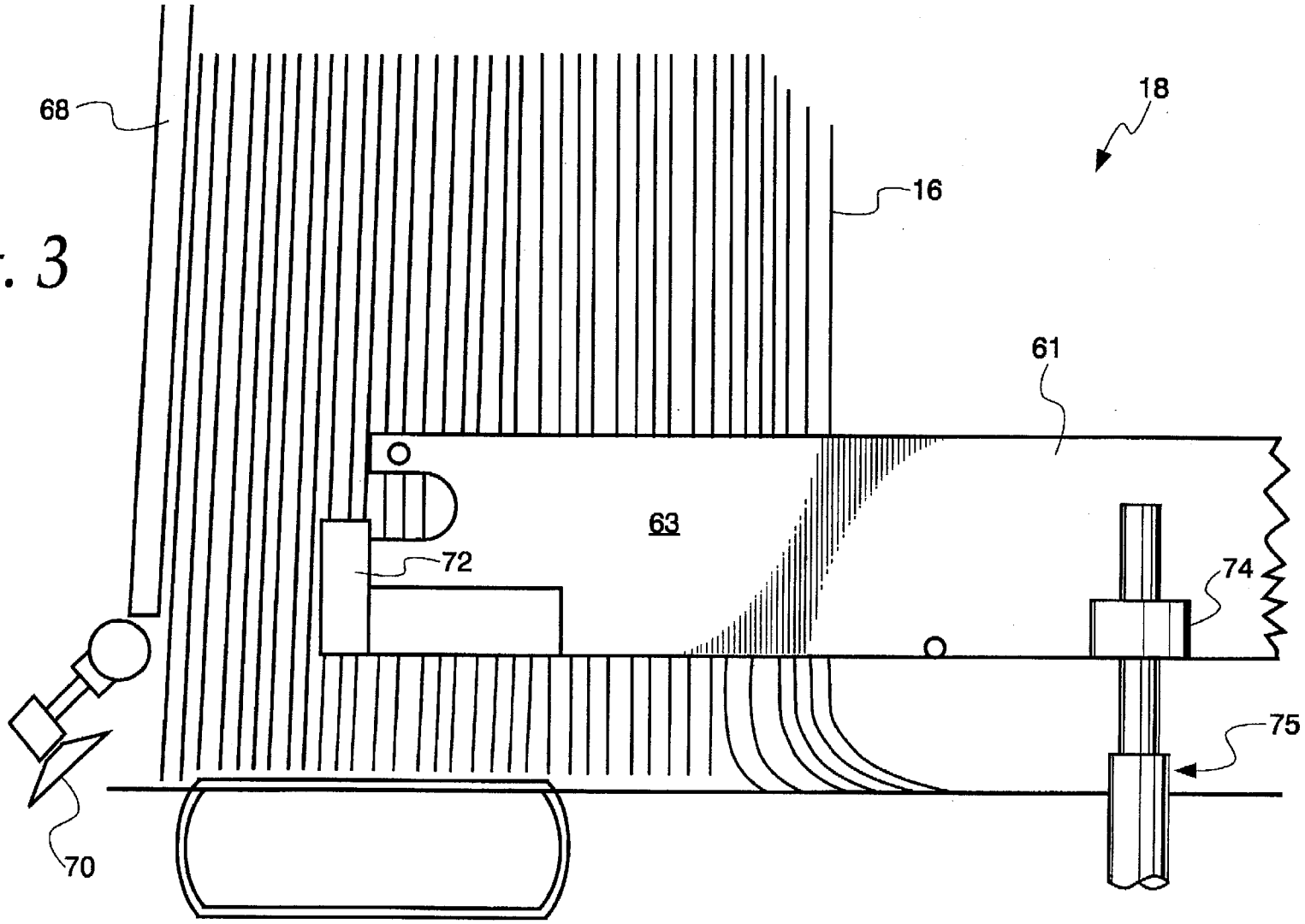
FIG. 3 is a side elevational view of a signature guide pocket having a retractable indicator.

The retractable side guides 72 are slidably mounted on the guides 61 and 62 (FIG. 19) to be moved from a retracted position shown in FIG. 3 to the extended position shown in FIG. 7 wherein forward edges 72*a* are adjacent the scale 65 for setting the front ends 63 of the signature guides. Herein the slidable movement of the indicator 72 between its retracted and extended positions is accomplished by having the signature guide formed with a slidable plate 72*b* (FIG. 6) having a forward indicating end thereon with the slidable plate being frictionally held against an outer side of the side guide by a pair of screws 72*c* which are inserted through an elongated slot 72*d* in the plate 72*b*. The screws do not tightly bind the plate to the side of the signature guide, but are frictionally held or biased there against because the screws 72*c* extend through a pair of washers and springs 72*f* to lock nuts 72*e*. The screws are threaded into the lock nuts to compress the springs against an angled backing plate 72*g* which is secured by a fastener 72*h* to the signature guide. This frictional retention by the screws 72*c* and the springs 72*f* allows the operator to grasp and push or pull the indicator 72 between the indicating position against closely adjacent the scale 65 or to the retracted position, as shown in FIG. 3.

Heretofore, each of the operators use different systems for sighting in the bows 64 for the signature 16 (FIG. 4B) to cause the signatures to stand straight in the pocket hopper 18 (FIG. 19). A bow is usually achieved by the operator's experience for a particular size of sheet or a particular thickness of signature. The bow is important to the proper feed of the sheets by the signature suckers 70 (FIGS. 3 and 7). An improper bow of a signature or a misalignment of a signature relative to the centerline of the pocket may result in a feeding jam, or may result in feeding of several signatures correctly, and then suddenly in feeding a signature incorrectly. A misfeed usually requires the bindery apparatus 10 to be shut down, and then a tweaking operation to be done to provide a correction for the misalignment. However, the misalignments when they are intermittent or are spaced apart with correct signature feeds are difficult to locate and correct. Thus, misalignments in the hopper should be eliminated in the first instance, if possible. To this end, the bow of signatures in the pocket hopper is preferably achieved automatically with the use of rear pocket scales 73 (FIGS. 4 and 5) which allow the bow to be automatically set when the outer portions 64 (FIG. 19) of the side guides 61 and 62 are set at the distance measured for the signature length which is the same dimension used for the signatures with respect to the backplate scale 65. Herein, this is achieved by having the pocket's backplate scale 65 (FIG. 19) set so that there is about a ¾" difference between them for the same readings that are on the pocket bar scale 73 and on the scale 65 at the backplate 68 (FIG. 3). For example, if the signature is 10" in length and the numbers 10 have been indicated by the retractable side guide indicators 72 (FIG. 19) on the scale 65, the same 10" may be used at the pocket bar scale 73, but the actual distance between the rear ends 64 and the side guide guides is 9¼"—the ¾" shortness being used to cause the bow of the signatures. Thus, in the preferred embodiment of the invention the operator does not have to do any calculations or use any judgment to obtain a bow. For the machines shown herein, the ¾" bow works for most signatures being used.

Figure 5:
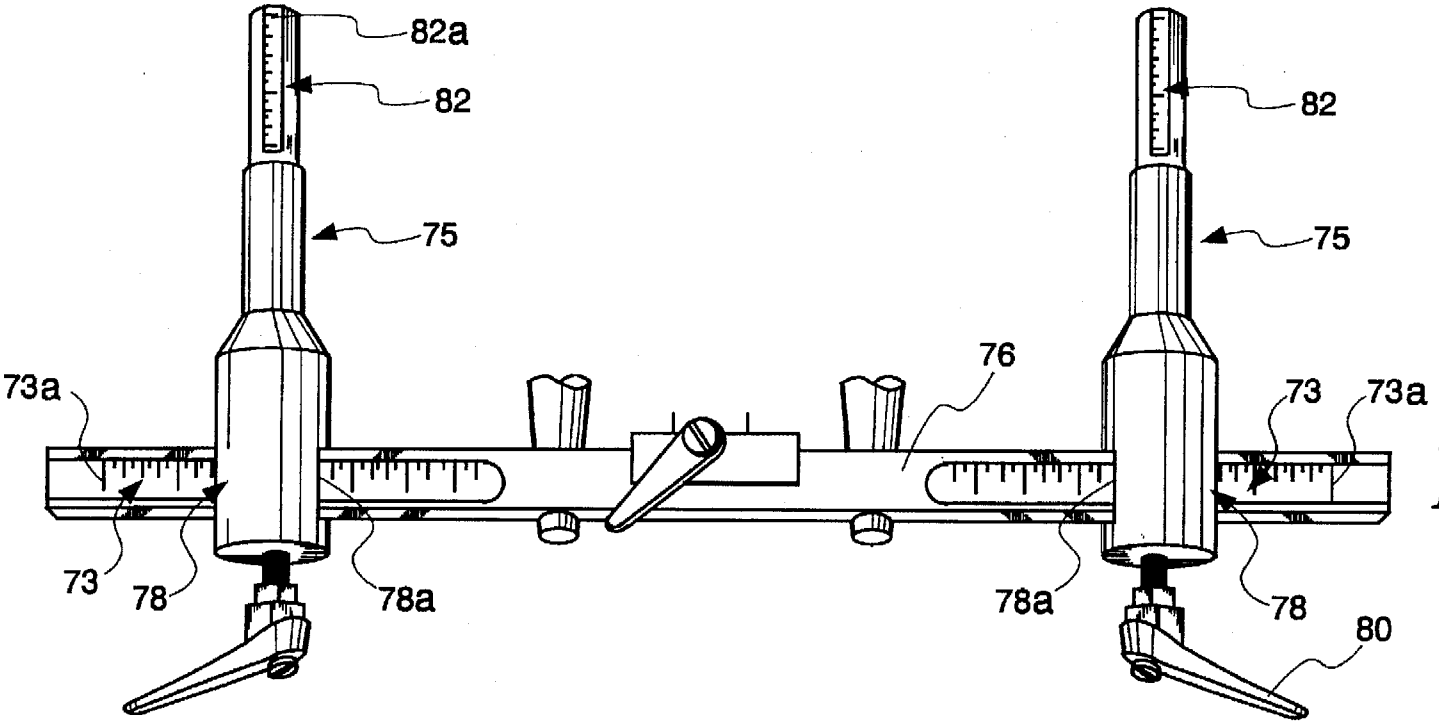
FIG. 5 is an elevational view showing a pair of pocket posts and a pair of pocket scales for the posts.
Figure 5B:
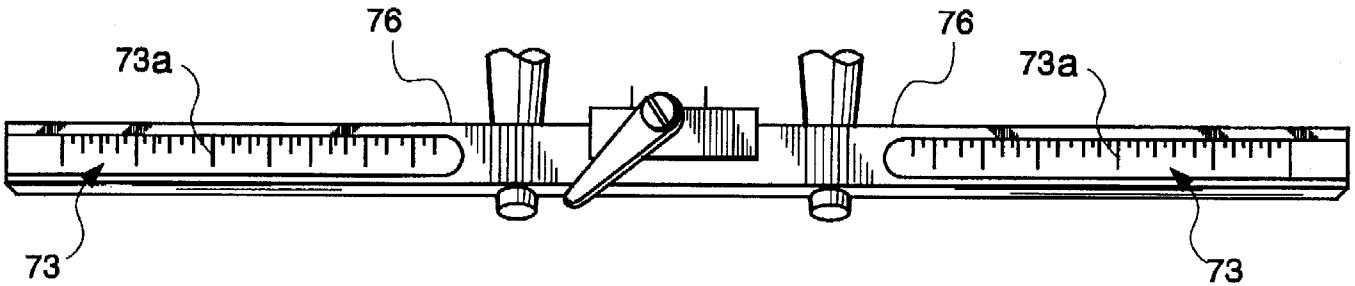
FIG. 5B is a figure showing the scales for the pocket bar location.

In the Muller pocket machine being described herein, the rear or outer ends 64 of the signature guides 61 and 62 are supported in cantilevered fashion by a top-supporting arm 74 (FIG. 4) which is mounted to and carried by a vertical pocket post 75 which is slidably mounted to slide horizontally on a bar 76 toward or away from the opposite signature guide. The pocket bar 76 extends horizontally as best seen in FIGS. 4 and 5. The pocket posts are slidable along the bar 76 by having slots 78 in their lower ends which are receiving therein the bar. A lower screw handle clamp 80 is provided and is turned to tighten and lock the pocket posts at the desired position along the pocket bar.

Their respective left and right pocket bar scales 73 are separated, as shown in FIG. 5, and they are similar to the backplate scale 65 in that they are to about half scale, except for the ¾" difference, and in that they have ascending numbers on the righthand portion from left to right and in the opposite for the lefthand portion with the numbers ascending right to left. Thus, the operator, for example, for a 10" length signature, will slide the right pocket post in FIG. 5 until an edge 78*a* of the slot 78 on the pocket post is at the proper indicia, viz. 10, and likewise will move the left pocket post until the edge 78*a* on the post 75 is also at the indicia 10. Thus, the operator need not have to do any mathematics nor do any sight adjustments to achieve a bow of ¾". The actual distance in this example between the left edge 78*a* and the right edge 78*a* is 9¼". The preferred scales 73 for the pocket bar are again small, linear strips with indicia 73*a* thereon; and the strips are graduated in ⅛" increments which in point of fact, is actually about 1/16" because of the fact that there are left and a righthand scale strips, as shown in FIG. 5. The scales 65 and 73 (FIG. 1A) were added and not present on the conventional pocket machine.

On the conventional pocket machine, the height of the signature guides 61 and 62 is generally determined by folding the signature vertically in half and then adjusting the signature guide so that it is located at one-half of the height of the signature. In the present invention, one may fold the signature in half and measure the one half with a tape measure, and use this measurement to set the side guides vertically on the pocket post. If one has the historical height for the side guides on the job card 67 (FIGS. 12A and 12B 17), one can use this height data to set the side guides 61 and 62 vertically. To aid in the proper vertical positioning, there has been provided a pocket post scale 82 which is attached along the vertical, upper end of each pocket post 75, as shown in FIGS. 4A and 5, with indicia 82*a* on the scale. In this instance, the scale 82 is to actual size—that is, 1" on the scale 82 and shown by the indicia 1 is actually a 1" measurement. The signatures guides are moved vertically along the pocket posts 75 in the usual manner and there is a clamping handle 74*a* which is attached to and cooperates with a top-supporting arm 74 to lock the signature guide in the adjusted vertical height position. Upper edge 74*b* of the cantilever supporting arm 74 is used as an indicator for aligning with the appropriate indicia 82*a* on the pocket scale 82 to set the signature guide at exactly one-half of the height of the signature. Thus, it will be seen that the spacing between the inner and ends of the signature guides, as well as the height of the signature guides, may be set to size without actually having to use a sample of the signature in the pocket itself.

The illustrated pocket post scale 82 is a thin strip which was added to the post. Preferably, the post was formed, as best seen in FIG. 4A, with the ¼" wide groove which is ⅛" deep and the scale 82 was set inside the groove. The pocket post scale in this example is about 3½" in vertical height, and displays a lower indicia of 2⅜" at the bottom through the indicia of 5⅞" at the top for this particular pocket machine. Manifestly, the scales could be considerably different for different machines.

The signatures 16 (FIG. 17) are fed from the pocket hopper 12 by the rotating gripper mechanism 14 to the gathering conveyor 22 which has a lug 22*a* which should be located immediately behind the trailing edge of the signature as it is deposited on the saddle 20. The signature has its opposite sheets spread over the triangular saddle 20 at the time of drop. The timing of the drop is one of the most arduous and time-consumingaspects of setting up of the conventional bindery line, particularly when one considers that there may be as many as 18 stations each with its own specialized drop. 0f course, this timing for the drop varies with the size of the signature. Heretofore, an operator would jog the lug 22*a* of the single gathering chain conveyor 22 to a position beneath the pocket machine, and then rotate the gripper mechanism to cause a signature drop to see how close it landed to the leading edge of the lug 22. If the lug was too far advanced, the signature would drop on top of the lug. If the lug was not sufficiently advanced, there would be considerable space between the signature dropping onto the saddle 20 and the approaching lug. The operator used primarily his judgment in this particular timing operation.

Figure 14:
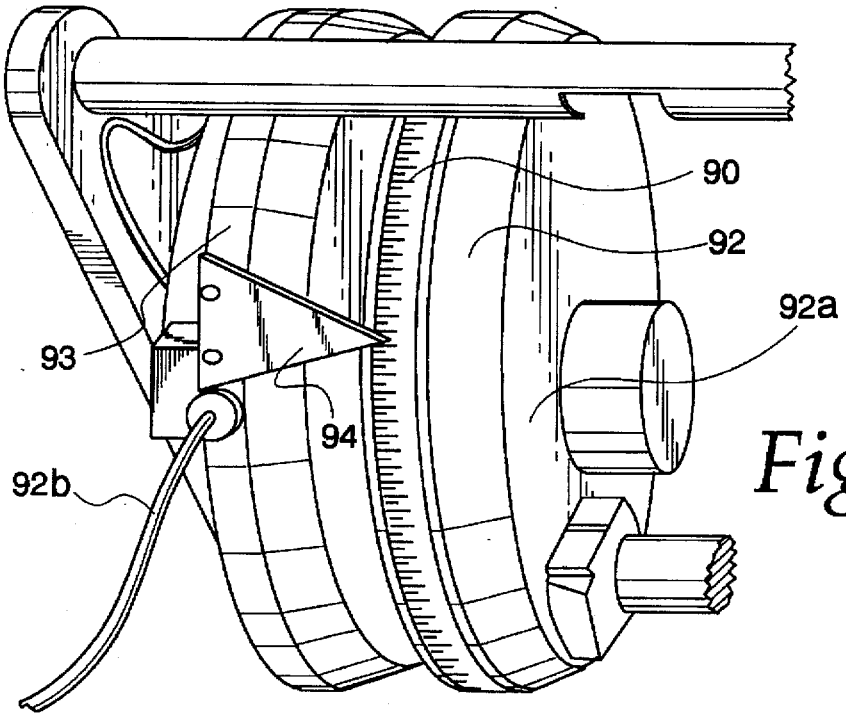
FIG. 14 is a perspective view of drop timing scale.
Figure 16:
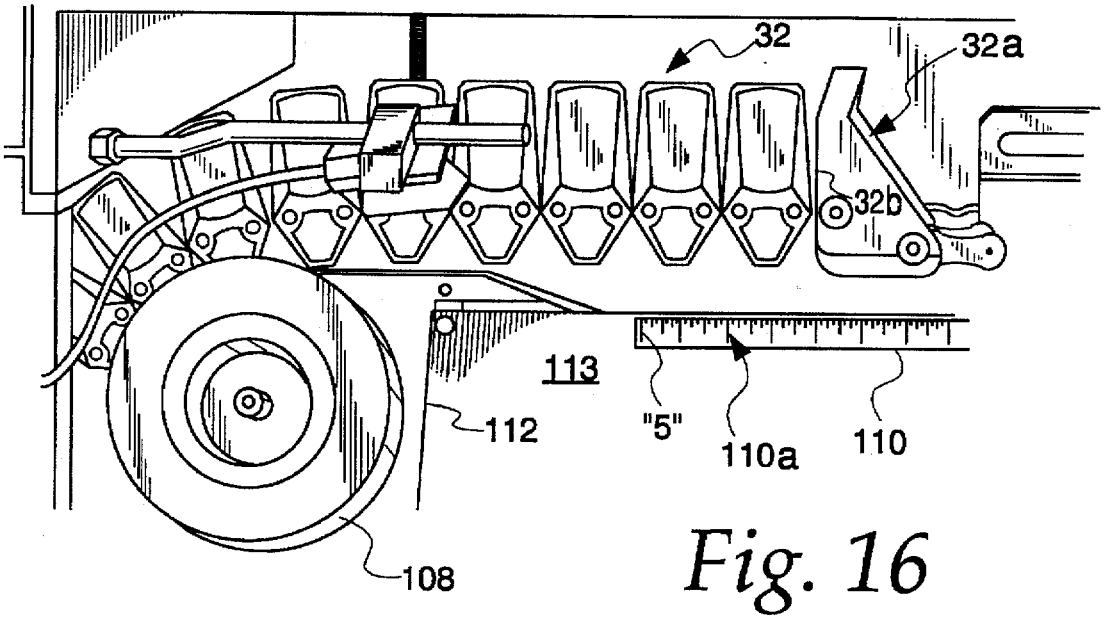
FIG. 16 is a view of the double chain conveyor scale.

In accordance with the present invention, the timing of the drop of the signature from the pocket hopper 18 to the gathering chain lug 22*a* is accomplished with the use of a scale 90 (FIG. 14) which is located on the upper gripper drum 92, as best seen in FIGS. 14 and 16. The gripper drum scale 90 rotates with the gripper drum 92, and a stationary scale indicator 94 is mounted to a stationary part 93 to cooperate with the scale on the gripper drum. Unlike the scales heretofore described in connection with the signature pocket, the scale 90 has no definite relationship to the measurable size of a signature. The scale is particularly useful when running the same job a second time. In such an event, the scale provides a reference to which the gripper drum is rotated to provide the same indicia as recorded opposite the indicator 94. Hence, the upper grippers should be timed to operate as they did the last time the job was run. If a new job is being run, the operator should use previous data obtained when dropping similar sizes of signatures in the past onto the saddle.

Figure 15:
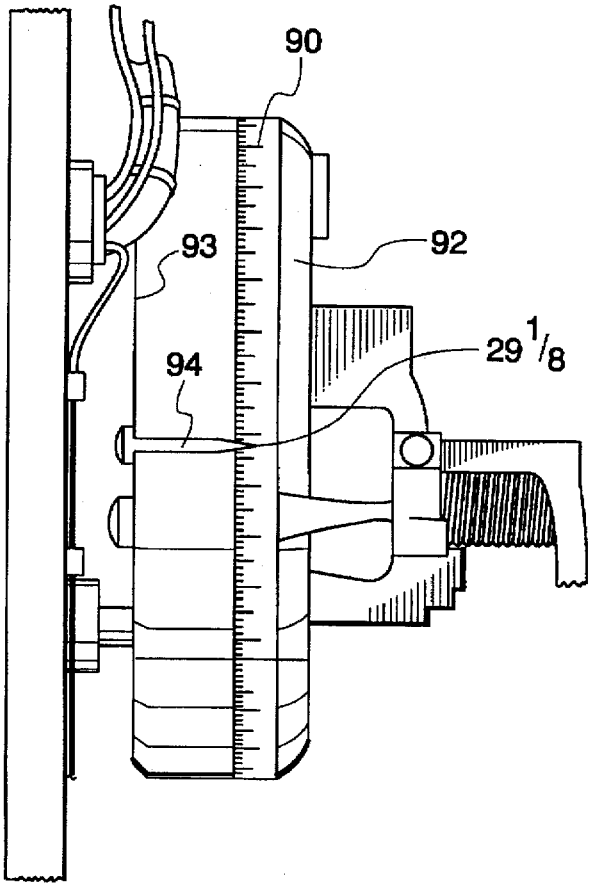
FIG. 15 is a side-elevational view of FIG. 14.

For example, if a signature measures 10" in length, and the operator had a number of previous job histories of indicia 29⅛ for signatures close to 10" in length, then gripper drum cam could be rotated to the 29⅛ indicia shown in FIG. 15 and used to approximate the drop. The particular gripper drum indicia are related to a reference point for the lug 22*a* (FIG. 17) on the single gathering chain when the bindery apparatus is locked out at reference position, viz., 100° (FIG. 23) in this instance. The scale 90 (FIG. 14) is only useful because the lug 22*a* (FIG. 17) has been precisely positioned on the conveyor chain 22 at a reference position. This reference position is 100° on a timing scale 80 and an indicator 81 (FIG. 21) for the main line drive for the gathering chains, as will be described hereinafter. When the bindery apparatus is locked out at 100°, the lugs 22*a* (FIG. 17) are precisely set on the chain 22 at the measured length distance for the particular signature and hence, timing of the drop from a machine 12 can be replicated from one job to the next, as will be explained in greater detail.

After running a job, if the upper grippers had to be tweaked by turning the gripper drum 92 (FIG. 14) with the scale moving therewith to a new indicia, then this new indicia is recorded in place of the original indicia so that the next time the job is run at this particular signature pocket feeder 12 (FIG. 17), the upper gripper mechanism cam 92 (FIG. 14) can be set to the final adjusted tweaked indicia so that the previous tweaking may be eliminated. The adjustment using the scale 90 permits a timing on the drop to the single lug gathering chain without having to jog the machine as before. That is, heretofore each of the stations 12 had to be jogged for the set-up of the drop; and every time one of the 18 stations was being jogged, then all of their operators working on the machine had to take their hands off that particular machine they were working on. For example, if an operator was making ready the trimmer machine, the stitcher machine, or one of the conveyors, the operator had to quit his work so that he did not get hurt while a jogging of the entire bindery apparatus 10 was taking place. In the present invention with the machine stopped and everything locked at the reference point of 100°, the pockets may be timed to the conveyor 22 (FIG. 17) using the scale 90 (FIG. 14) and the indicator 94 without any jogging. Indeed, if one job is being run and a particular pocket machine 12 (FIG. 17) is not being used, it can be set to the particular timing using the scale 92 (FIG. 14) without having to jog the machine and it can be set up prior to the finish of the currently running job.

Figure 13:
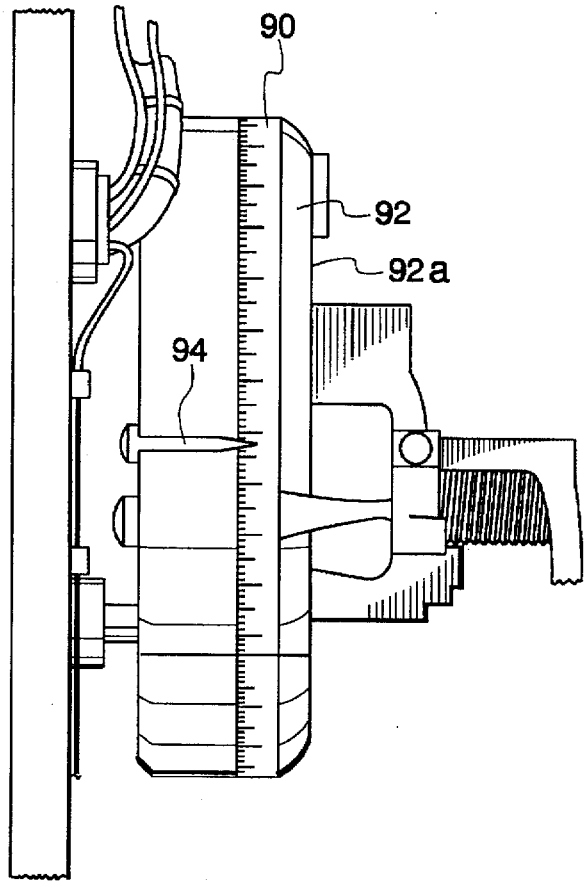
FIG. 13 is an elevational view showing the upper drum gripper scale for timing the pocket to the gathering chain.

In the particular Muller machine shown herein, there is a stop bar at which the upper gripper drums 95 (FIG. 11) move and grab the sheet from the suckers 70 (FIG. 3) and rotate it up to hit the stop; and then the lower gripper drum 96 (FIG. 11) grabs the lower edge of the sheet when it is hitting the stop and pulls it downwardly. The Muller machine is provided with a semicircular stop bar scale 91 that is stationary, and a movable indicator 91*a* is movable with the stop bar and points to a location on the scale 91. There is also a brush bar scale 93 and an indicator for setting the brush bar which brush the laps, as is well known. The preferred scale 90 is merely a thin strip which is secured by a fastener, such as an adhesive to the circular, peripheral surface of the cam 92 (FIG. 13). While the location of the scale 90 can be placed on the cam at various rotated positions to determine where "0" on the scale 90 is located, it is preferred to locate the "0" indicia 90*a* opposite a cam bolt 92*a*, as shown in FIG. 14, and to locate the indicator 94 at a distance of ½" from the center oil line 92b to the center of the bottom hole, as shown in FIG. 14 for a 279 pocket machine. For 316 and 342 pocket machines, the "0" and indicator 94 (FIG. 15) may be attached at slightly different locations.

Figure 11:
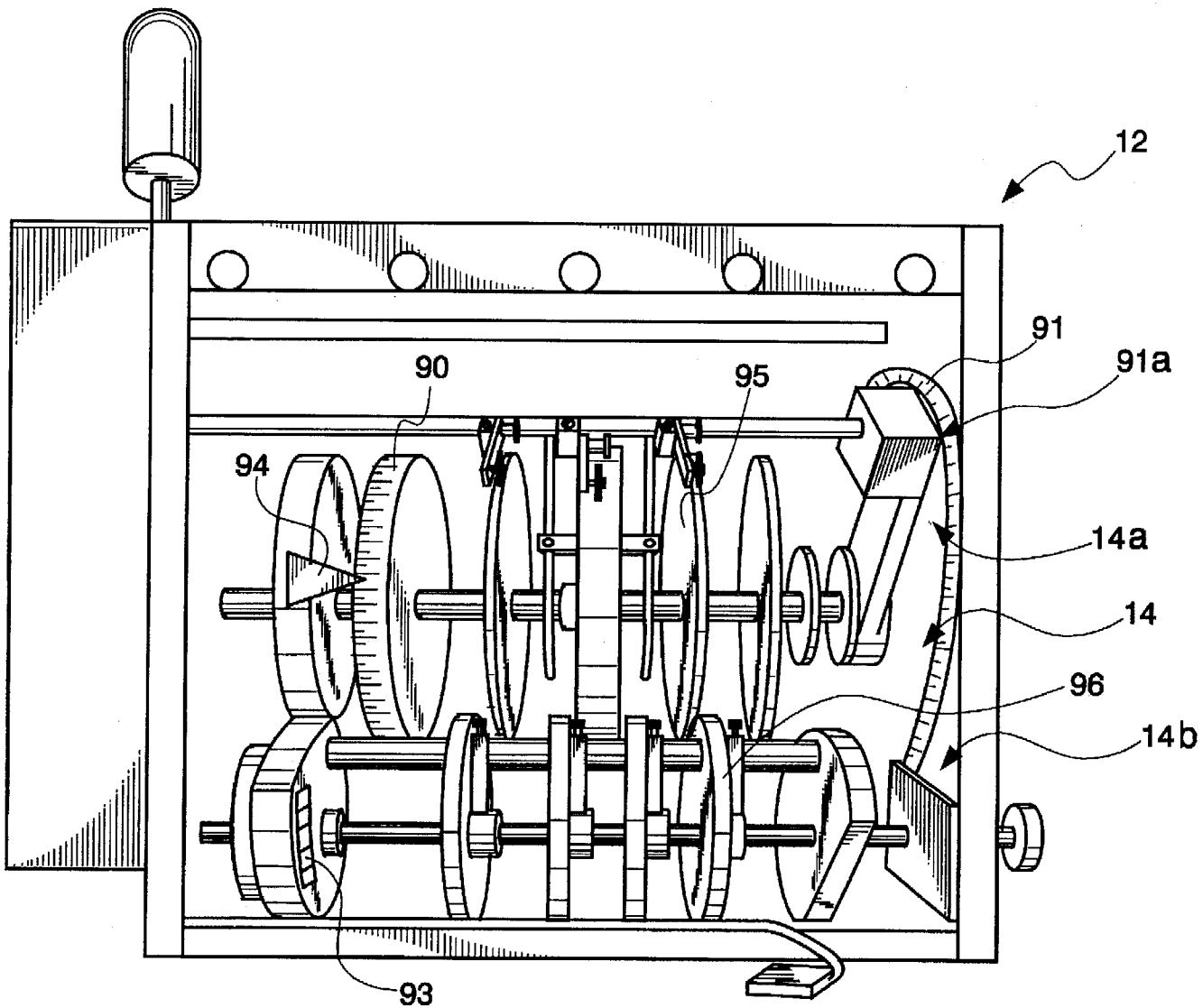
FIG. 11 is a view taken from the operator's viewpoint of the upper and lower gripper drums and upper gripper drum scale used.
Figure 17:
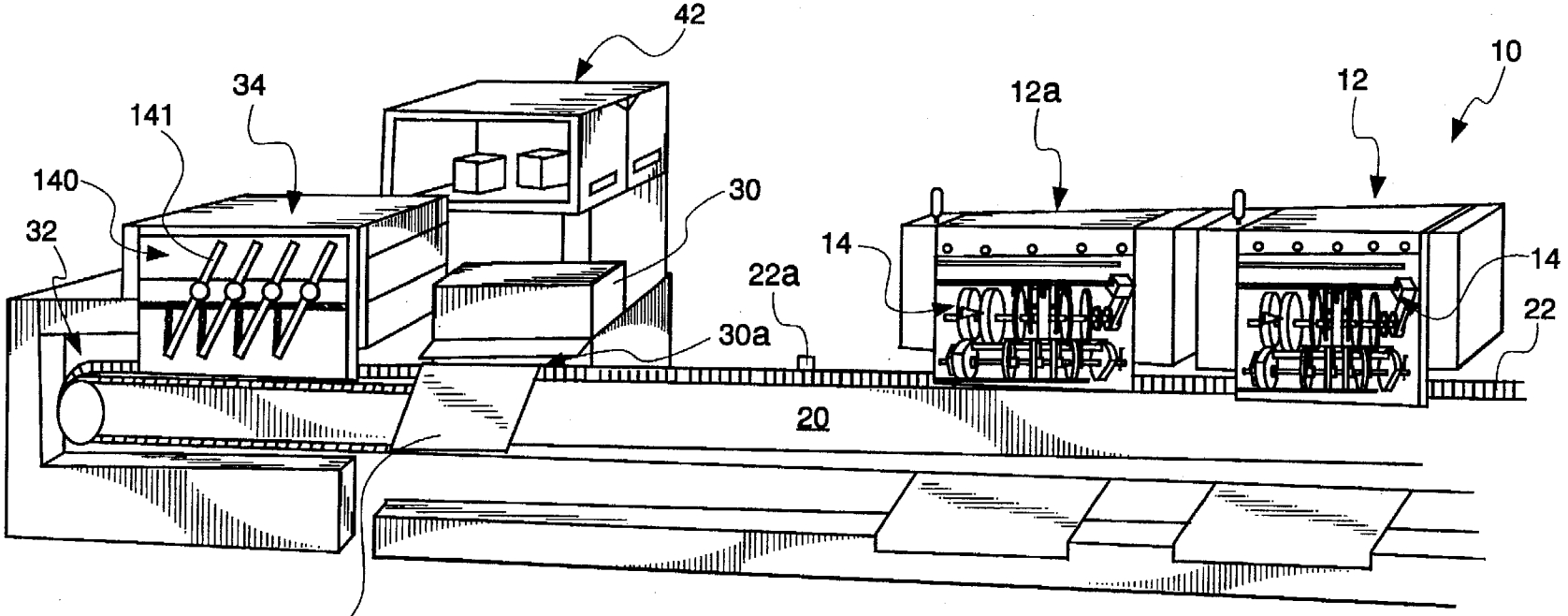
FIG. 17 is a diagrammatic view of a binding apparatus constructed in accordance with the preferred embodiment of the invention.
Figure 20:
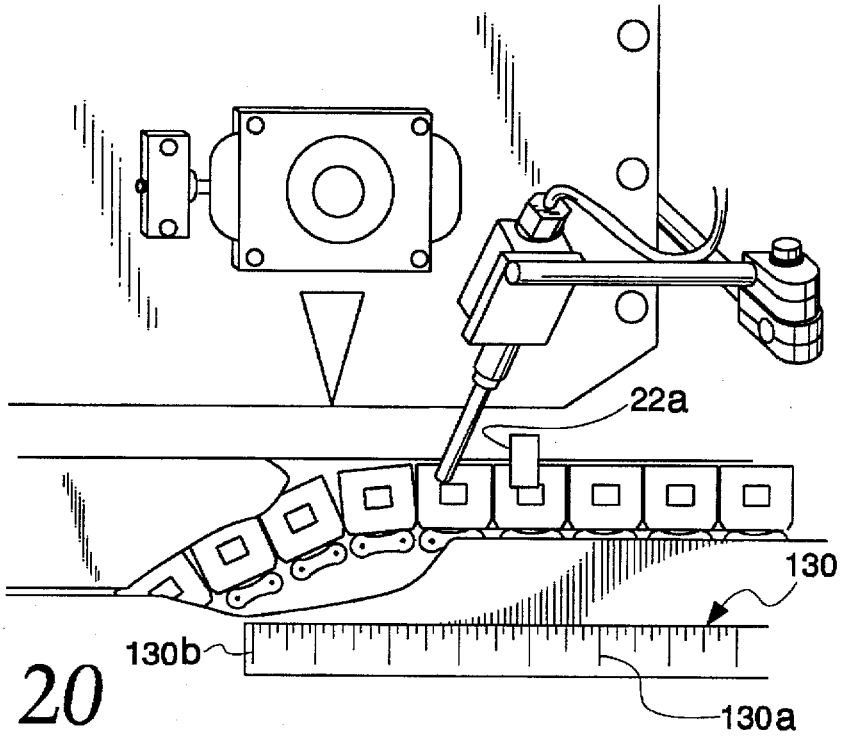
FIG. 20 is an enlarged view showing the single gathering chain lug timing scale.

The upper gripper drum 95, as best seen in FIG. 11, is part of an upper gripper drum mechanism 14a that has one or two grippers that grip the signature removed from the signature hopper by the suction gripper 70 (FIG. 3). As is well known, the upper gripper drum mechanism 14a is connected to and timed with the lower gripper drum mechanism 14b; and this lower gripper drum mechanism is adjusted when one shifts the upper gripper drum mechanism so that the timing of one also times the other at the same time. Using a scale 92 (FIG. 15), as above-described, at each of the pocket signature stations allows timing of their respective upper and lower gripper drums for their particular drop to the conveyor chain lug 22 (FIG. 17). Because the lug 22a is traveling in the advancing direction and because each signature feeder is at a different position relative to the saddle, each subsequent signature feeder is separately timed to drop its signatures to the saddle.

The signatures, after they are dropped onto the saddle 20, are conveyed first by the single gathering conveyor 22 to the transfer station 30 and its transfer conveyor 30 at which one of three lugs 30a on the transfer conveyor 30 picks up a book form from the single lug chain conveyor 22 and conveys this book form to the double lug conveyor 32 (FIG. 16) which has double lugs 32a thereon. The double lugs 32a convey the book form through the stitcher station 34 (FIG. 17) where it is stitched and then delivers it to the trimmer infeed conveyor 38 (FIG. 24) which carries the book form now stitched directly into the trimmer machine for trimming the book form. The double gathering chain 32 (FIG. 16) must be precisely timed to delivery the booklet form 26 (FIG. 9) into the center of the infeed conveyor 38 (FIG. 24) or a malfunction of the trimmer may occur, and a jam up in the trimmer which will shut down the entire bindery apparatus.

Figure 21:
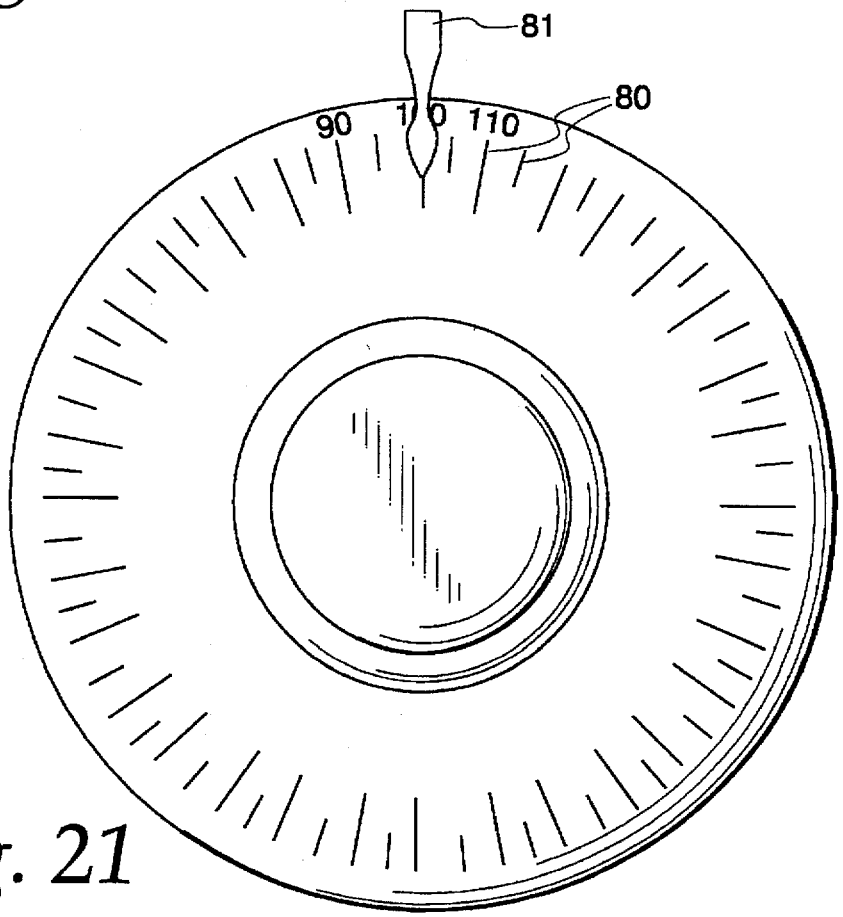
FIG. 21 is a view of a scale for the main line drive and reference point.
Figure 23:
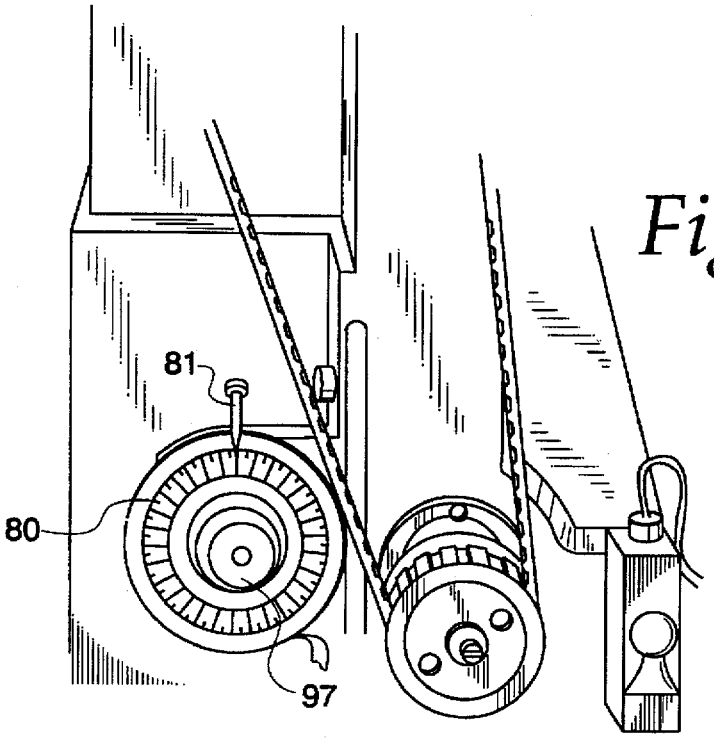
FIG. 23 shows a main line scale used for locking out the machine.

The present invention provides a quick and easy way of setting up of the respective conveyors without having to jog or run the machine as heretofore was the practice. Because the last saddle conveyor 32 (FIG. 16) must be timed directly to the trimmer infeed conveyor 38 (FIG. 24) which conveys the stitched book forms off to the trimmer, the conveyor 32 (FIG. 16) is first adjusted to its position with the main line drive 97 (FIG. 23) set at a reference point, which in this instance, is 100°. The main line drive 97 is locked out, that is, stopped at a reference point, as shown by a main line indicator 81 and a main line rotary, indicator scale 80 (FIGS. 21 and 23). The entire make-ready or set-up is done with the bindery apparatus stopped and locked at the reference position.

Heretofore, the operator had to put a signature on the double gathering chain 32 (FIG. 16) and approximate the amount that the double gathering chain had to be adjusted by rotating a double gathering chain adjustment wheel 108 (FIG. 16) and then having adjusted that, the operator placed a signature onto the transfer station and approximated the amount that the transfer station had to be adjusted by using a similar hand adjustment wheel for the transfer conveyor 30 (FIG. 17). After the chains had been sighted and adjusted, the conveyors were jogged and tweaked.

In accordance with the present invention, the double gathering chain conveyor 32 (FIG. 16) is at its position where it is located from the last run job that was run, and this position is at the 100° line lock out reference positions of FIGS. 9 and 23. There is provided a timing scale 110 (FIG. 22) (which is a one-half scale where a gradation of "1" equals a distance 0.50 inch). The timing scale 110 is used to set the lug 32a to the new length for the new signature that is to be run. To set up other machines, a scale should be brought to the saddle and positioned on the saddle where the last signature was run with the scale indicia located at the edge of the double lug indicating the length from head to foot for the last run signature. Then, the new scale will be fastened to the saddle. Hence, movement of the double lug to a new indicia along this scale will result in the lug being downstream for smaller signatures or upper stream for larger signatures from the lug position when the scale is first secured to the saddle. All of the gathering conveyor scales may be located in the same machines.

Figure 22:
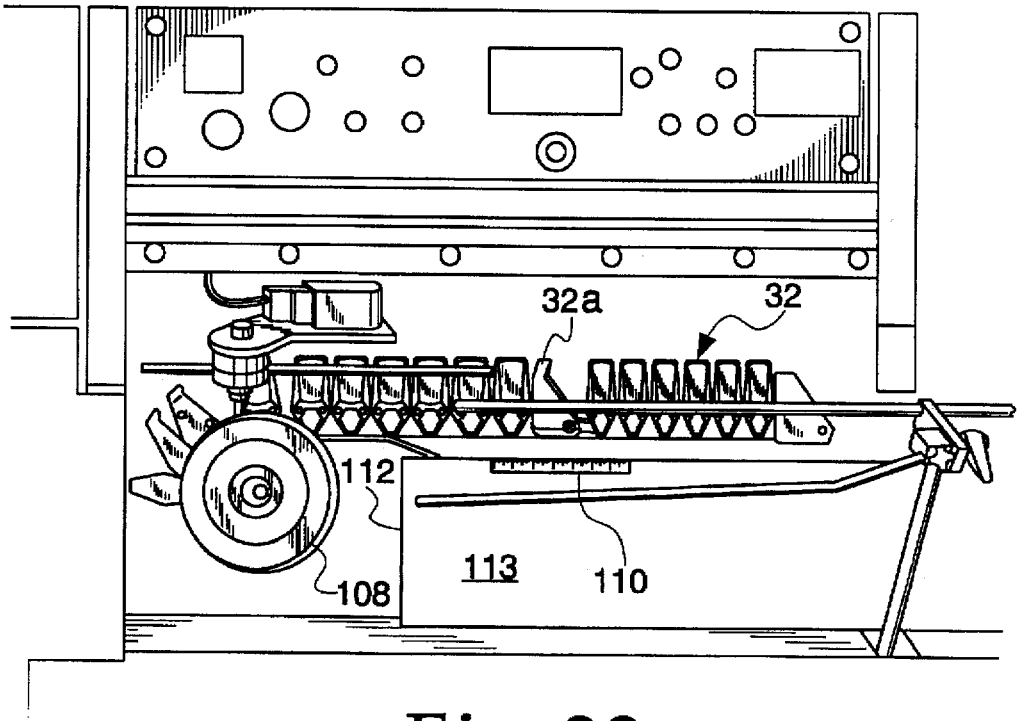
FIG. 22 illustrates the 90° double gathering chain scale.

With the double conveyor 32 disengaged from the main line drive, the hand wheel 108 is turned to move the lug 32a to the half length measurement on the scale 110. This is usually accomplished by taking a signature edge and abutting it against a leading edge 32b (FIG. 16) of the double gathering chain lug 32a, and advancing the lug until the signature edge is aligned with the proper indicia 110a on the scale 110. Thus, in the example being used herein if the lug 32a is to be used with a 10" long signature, then the lug 32a would have its leading edge 32a opposite the indicia 110a which is the numeral "10" on the double gathering chain scale 110, as seen in FIGS. 16 and 22. Thus, it will be seen that the signature measurement is used to set the lug 32a (FIG. 16) on the conveyor 32. If these signatures had measured 10½" long, then the leading lug edge 32b would have been set to 10½" on the scale 110 rather than to 10" as above-described.

Heretofore, the timing of the transfer conveyor 30 (FIG. 17) and its three transfer conveyor lugs 30a to the respective 32a (FIG. 1) on the double lug conveyor 32, and to the lugs 22a on the single lug conveyor 22 was difficult. With the present invention, however, there is provided a transfer station scale 120, as shown in FIG. 2, which extends generally horizontal with the scale units ascending from left to right. The preferred scale 120 is a flat strip which is located horizontally along a lower edge 121a of the transfer unit frame 121, and immediately above a transfer lug 30a which travels therebeneath, as shown in FIG. 2. The transfer lug 30a is an overhead lug in the sense that it is located above and travels in a plane above the lugs 22a (FIG. 1) on the gathering conveyor and above lugs 32a on the double gathering chain 32. To time the transfer station lugs, the main line drive has been previously locked out at the reference point of 100°, and the transfer conveyor has been disengaged from the main line drive. Then, using a transfer gathering chain hand adjustment wheel 122, the transfer conveyor lug 30a is moved along the scale 120 until its leading edge 30b is located beneath the indicia on the scale 120 for the particular length of untrimmed book form being fed. In this illustrated example of the invention, the length is 10" The indicia 102a on the scale 120 read from left to right in ascending order and are located apart ⅛". After positioning the lug 30a, the transfer conveyor is re-engaged to the main line drive.

Figure 1:
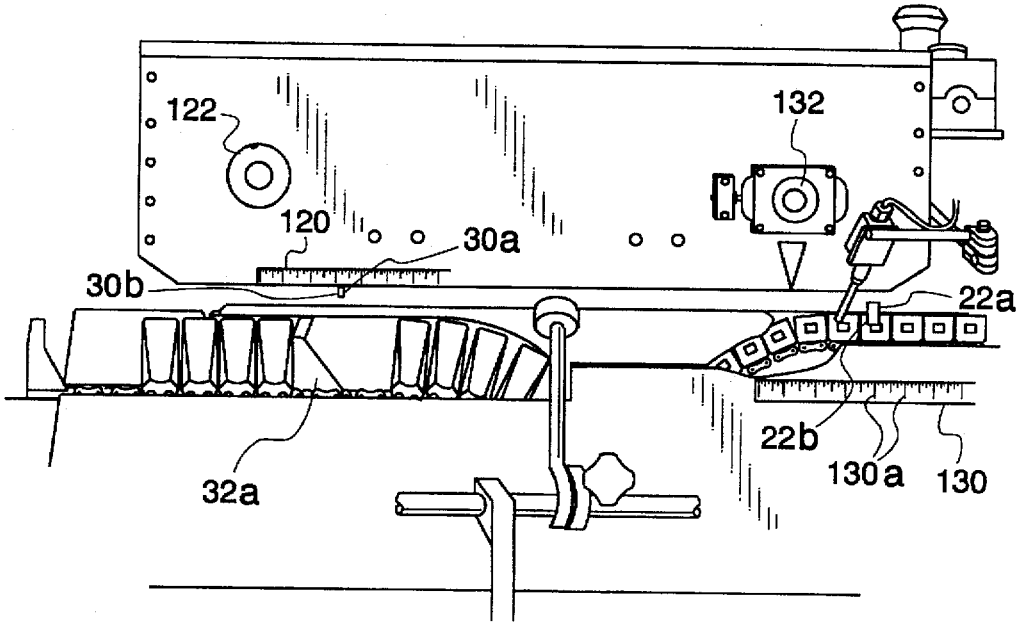
FIG. 1 is a view of the double lug and transfer scales.
Figure 2:
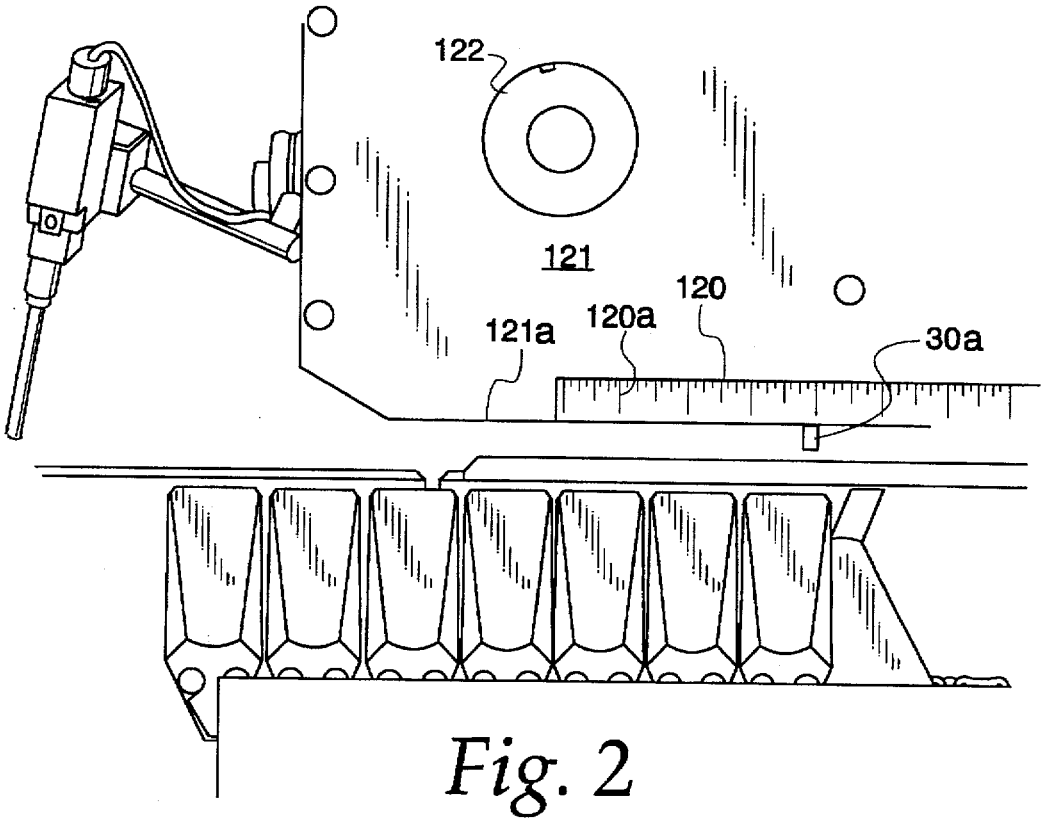
FIG. 2 is an enlarged view of the transfer station scale.
Figure 1A:
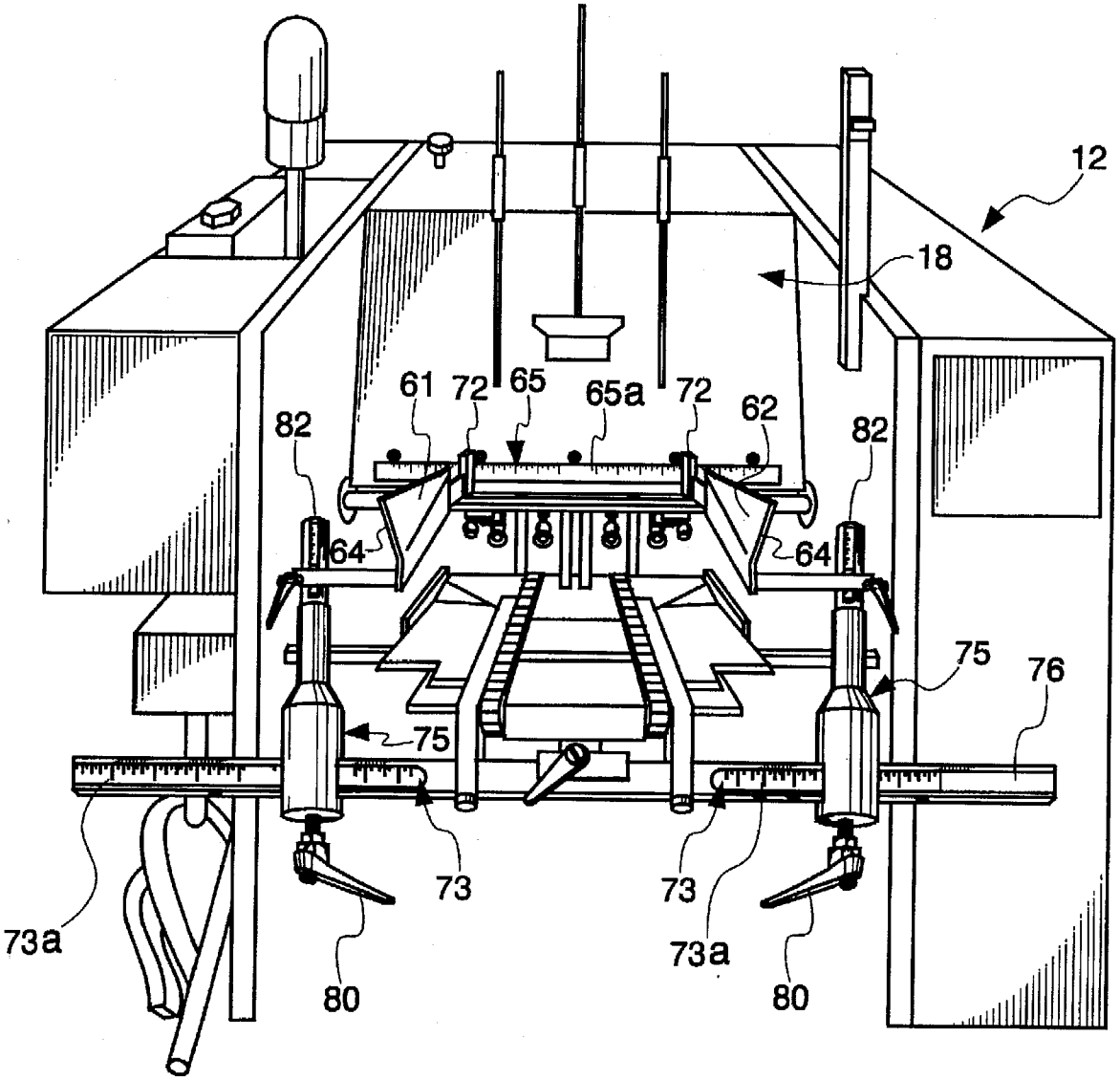
FIG. 1A is a view of a signature guide apparatus.

As best seen in FIG. 1, the transfer station scale 120 is located over the receiving end of the double lug gathering chain where the transfer conveyor is delivering the booklet form to the double gathering chain 32. As shown in FIG. 1, the single gathering chain lug 22a will next be set in its position relative to the transfer station lug 30a by the use of a single gathering chain timing scale 130 which has indicia 130a thereon. As best seen in FIG. 21, the single gathering chain scale is located at 14¼" from a reference point to the indicia 5 at 130*b* on the scale 130 to locate the scale relative to where the reference point is when the machine is locked out at a reference of 100°. The single gathering chain lug 22*a* has its leading edge 22*b* set in the same manner as the previous settings by disconnecting the single gathering chain drive from the main line drive and using a hand adjustment bolt (not shown) to move the lug leading edge 22*b* to where a signature booklet has been placed along the scale at the appropriate indicia for the measured length. Thus, the leading edge 22*b* in the illustrated example for the 10" signature would have its leading edge 22*b* set opposite the indicia 10 on the scale 130 to time the lug 22*a* relative to the transfer conveyor lug 30*a* which has been previously timed. The single lug conveyor 22 is then re-engaged with the main line drive. The preferred scale 130 is located on a saddle plate 133, as best seen in FIG. 21, beneath the upper run of the single gathering chain lug 22*a* and adjacent the end of the single gathering chain conveyor's upper run. The preferred scale is a small, thin strip which is secured to the Muller saddle.

After having timed all of the lugs, they are in position to be timed to the drop from the signature feeder. As above explained, the gripper mechanisms have been set using the gripper cam scale 92 (FIG. 14) to set the gripper mechanisms 14*a* and 14 (FIG. 11) to drop to the lug 22*a* (FIG. 17) now at the position for this particular job. Thus, each of the conveyors used to gather and transport the signatures is set in precise locations without having to jog the machine and can be set simultaneously with other people setting their gripper mechanisms 14 and 14*b* (FIG. 11) for their respective pocket signature machines. It has been found that the scales used with these various conveyors eliminates the need for readjustment, and reduces the amount of time required to set up the chains, reduces the waste associated with errors occurred during set up. Additionally, of course, the amount of waste used when jogging and correcting and tweaking have been very substantially reduced by the use of the respective scales with their respective conveyors as above described.

Figure 10:
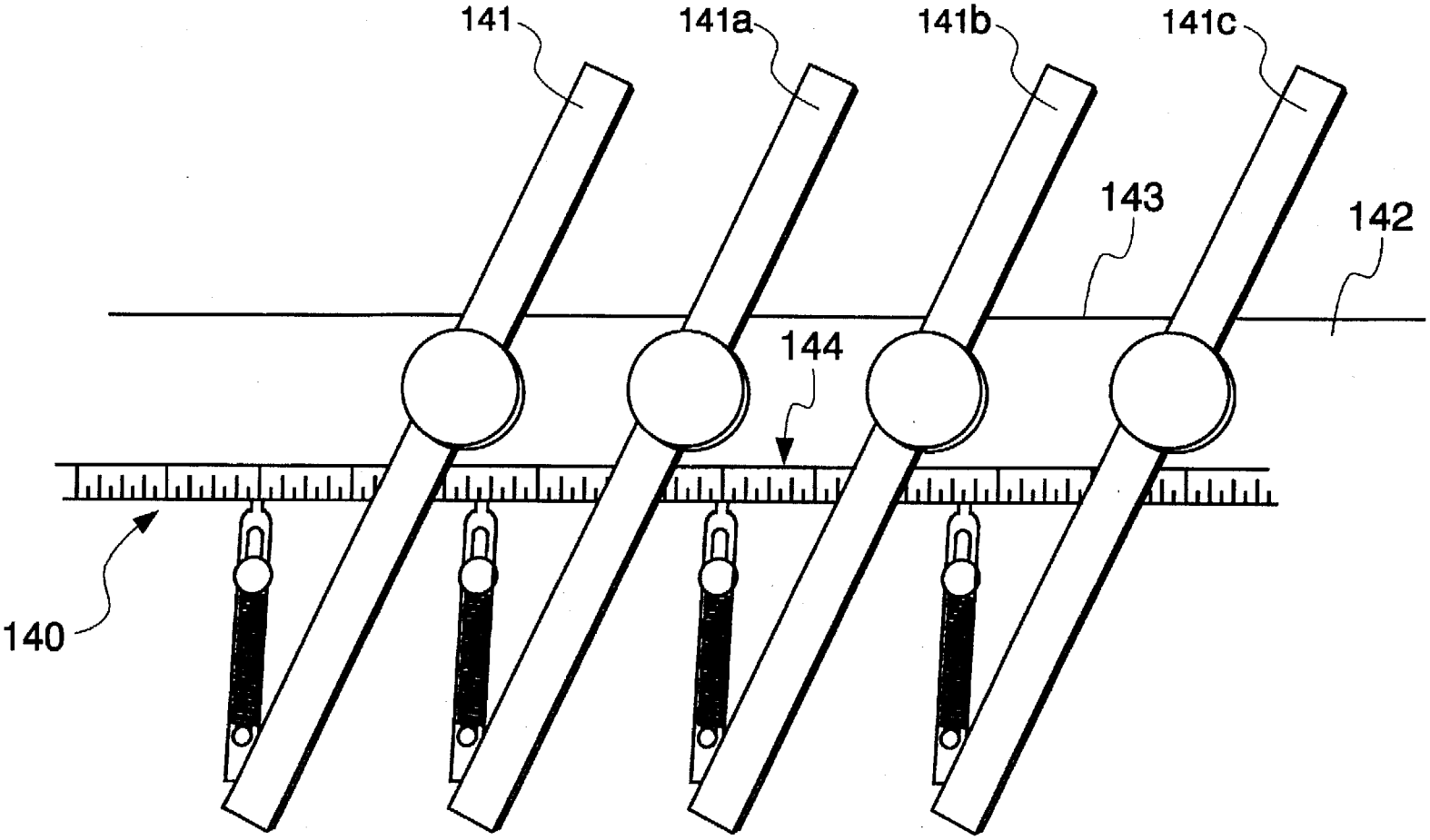
FIG. 10 is a partial view of the stitcher apparatus.

The double lug conveyor 32 (FIG. 16) delivers the booklet forms travelling along the saddle 20 (FIG. 17) into the stitcher's station 34 at which is located a stitcher carriage 140 (FIGS. 17 and 10) which has a plurality of stitcher heads 141 (FIG. 17) each of which is moveable along a frame 142 (FIG. 10) to an adjusted position relative to the saddle. The particular setting of the stitching heads is herein done ahead of time and is done by measuring the folded portion of the booklet between its foot and head and deciding at how many inches will be located in the stitches. Having decided and measured where the stitches are desired, then the respective stitcher heads 141 may be moved along a rail 143 to positions opposite an indicator scale 144 (FIG. 10) which has indicia thereon which are related to the size measurement of the respective head to foot measurement.

If a first stitcher head (FIG. 10) is to be located, for example, to make a stitch at two inches, the first stitcher head 141*a* will have a position along the rail of 143 adjusted until a book form edge from its centerline of the stitcher head is aligned with the indicia "2" on a scale 144 beneath the stitcher heads. If the other stitcher head 141*b* is to put a stitch at eight inches, then stitcher head 141*b* is moved along the rail 143 using the edge of a signature to align its centerline with the indicia 8 on the scale 144. Thus, there is no need to readjust the stitcher heads along the rails and to tweak them, as is sometimes done when using the conventional Muller stitcher which lacks the scale 144. Particularly, when there has been a previous job and the exact stitcher locations have been noted, the stitcher heads may be positioned during make-ready with the stitcher heads at the exact positions because of the scale 144 which is attached to the saddle also. The scale 144 is of actual size and is positioned so that the booklets receive the stitchers exactly where desired. The scale is a thin strip fixed in a horizontal stationary position on a frame member of the stitcher.

That is, rather than waiting until after they had produced product and measured the product and then doing readjustments, the stitcher heads may be set initially to the same positions previously used thereby eliminating any adjustments that were done heretofore using the machine in the conventional manner.

Figure 33:
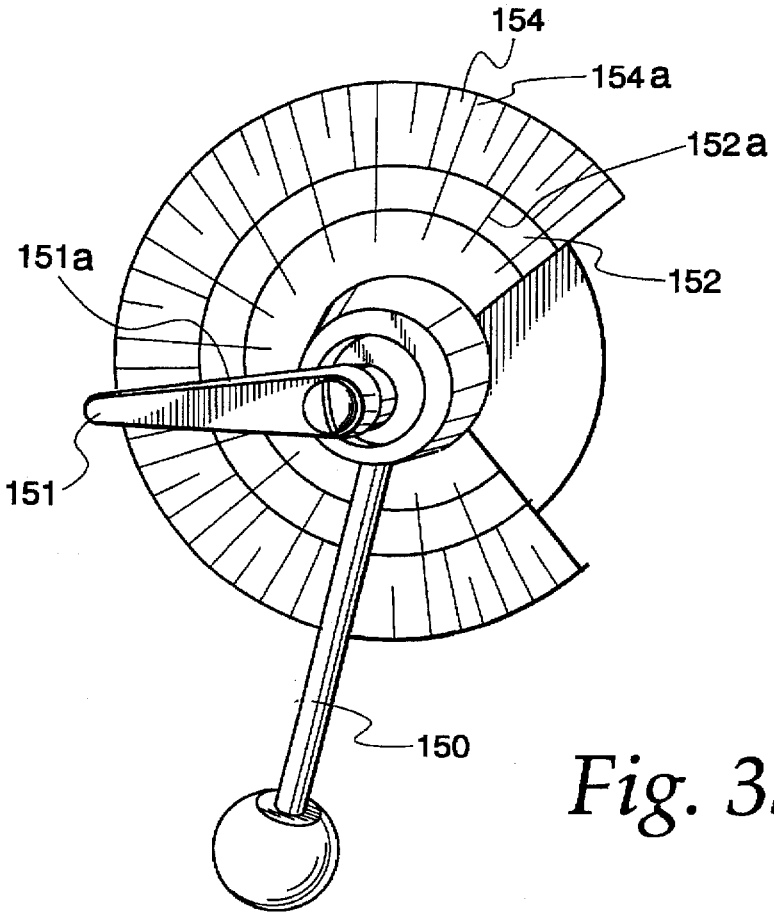
FIG. 33 shows a belt tension scale and belt tension adjustment handle.

At the trimmer machine, the book forms are fed by the in feed chain conveyor 38 (FIG. 24) to a position between a pair of upper belt conveyors 40*a* and a pair of lower belt conveyors 40*b*, which deliver the book forms to the trimming knives. The spacing between these respective upper and lower conveyor belts 40*a* and 40*b* is adjusted by using the so-called belt adjustment handle 150, as best seen in FIG. 33, which was used in conjunction with an inner scale 152 which had scale gradations 152*a* measured in ⅛ of an inch. The scale 152 is provided on the conventional Muller trimmer machines. However, the scale gradations 152*a* of ⅛ of an inch were related to an indicator 153. These gradations 152*a* were not found to be detailed enough because the belt tension could not be set very precisely, and again, it took some operator adjustment at different times to obtain the correct belt tension. A difference eight sheets or less could not be easily detected or accounted for with the scale 152.

The adjustment of the spacing between belts 40*a* and 40*b* is achieved turning a locking lever 151 to its unlocking or loose position. At this position, the lever 150 may be rotated to bring the belts closer together or farther apart. When properly set, the locking lever 151 is turned in the reverse direction to its locking position to lock the lever 150 against inadvertent turning.

To alleviate the operator using judgment for the belt tension, an additional finer scale 154 has been provided to encircle the inner scale 152 which came with the machine. The scale gradations 154*a* on the scale 154 are at 1/64 of an inch and are used with the indicator 151. Thus, the operator may readily adjust the belt tension to a more precise position so that there is no need for any readjustment due to belt tension. This is another example of how to eliminate tweaking and how to eliminate the need for experience in the operator, particularly when running a job a second time. The operator will consult the job card 67 (FIG. 12) and take the reading off for the belt tension and set it accordingly using the indicator 151 and the fine gradation of 1/64 of an inch, which are indicated by the indicia 154*a*, to obtain a more precise control over the belt tension.

In accordance with the present invention, there is provided a simplified set-up of the book trimmer which will use scales for setting up head and foot knife assemblies as well as the face trimming assembly as will be described in great detail hereinafter. A trimmer can be set up properly and accurately without using a specific specified training of the operator, or the operator using a subjective judgment. The operator's subjective judgment and/or an operator's lack of experience often results in the need for later readjustments at the trimmer. This, of course, often results in waste and additional time used for tweaking and results in quality problem because of set up errors with the trimmer. With present invention, the trimmer can be set up to precise size by the finished product without having the product available and without having to jog the trimmer as with the prior conventional systems.

Figure 25:
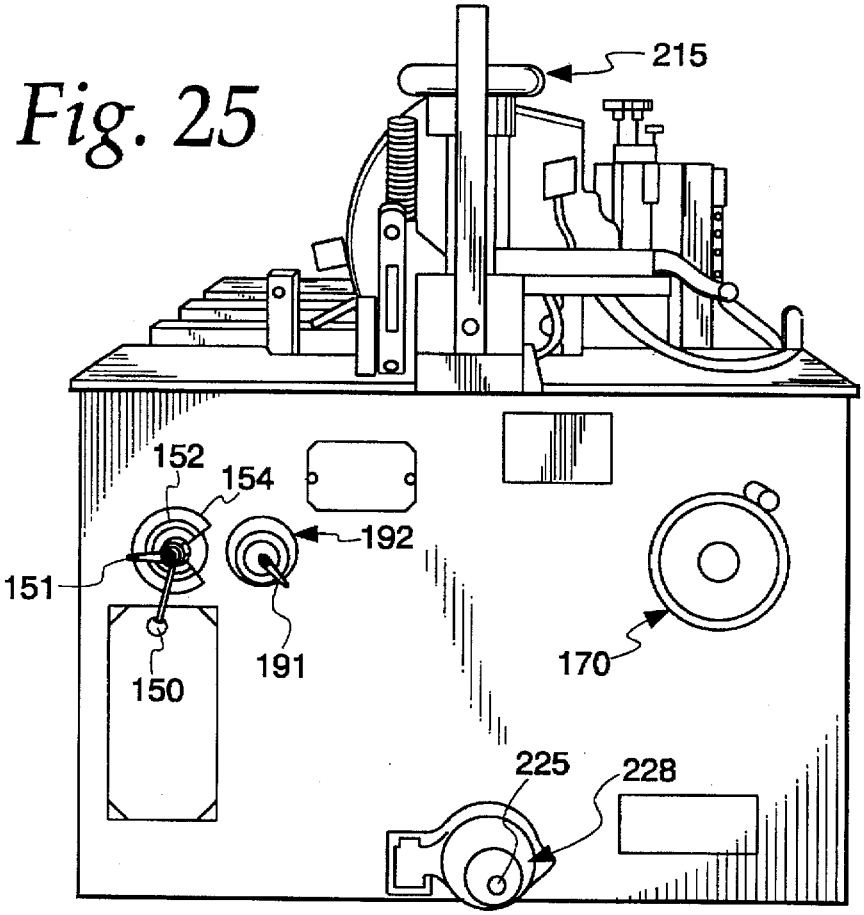
FIG. 25 is a side elevational view of the trimmer apparatus shown in FIG. 24.
Figure 30:
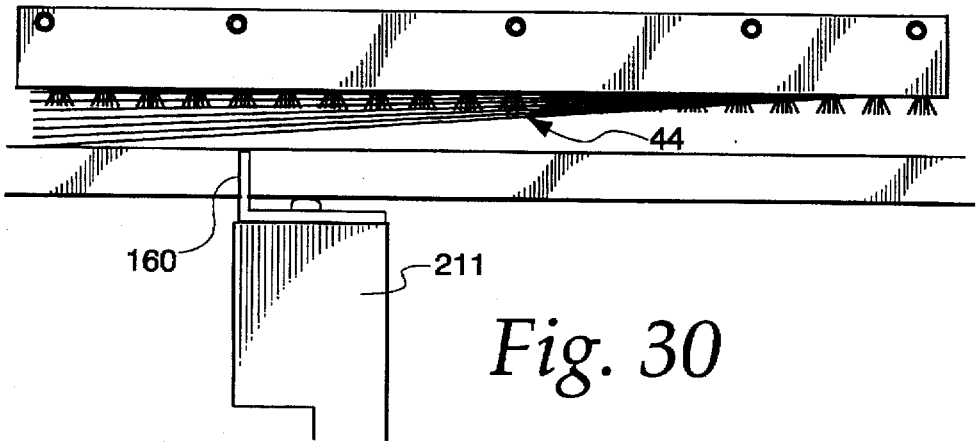
FIG. 30 is a side elevational view of a head and foot knife and a book form stop used in conjunction therewith.
Figure 29:
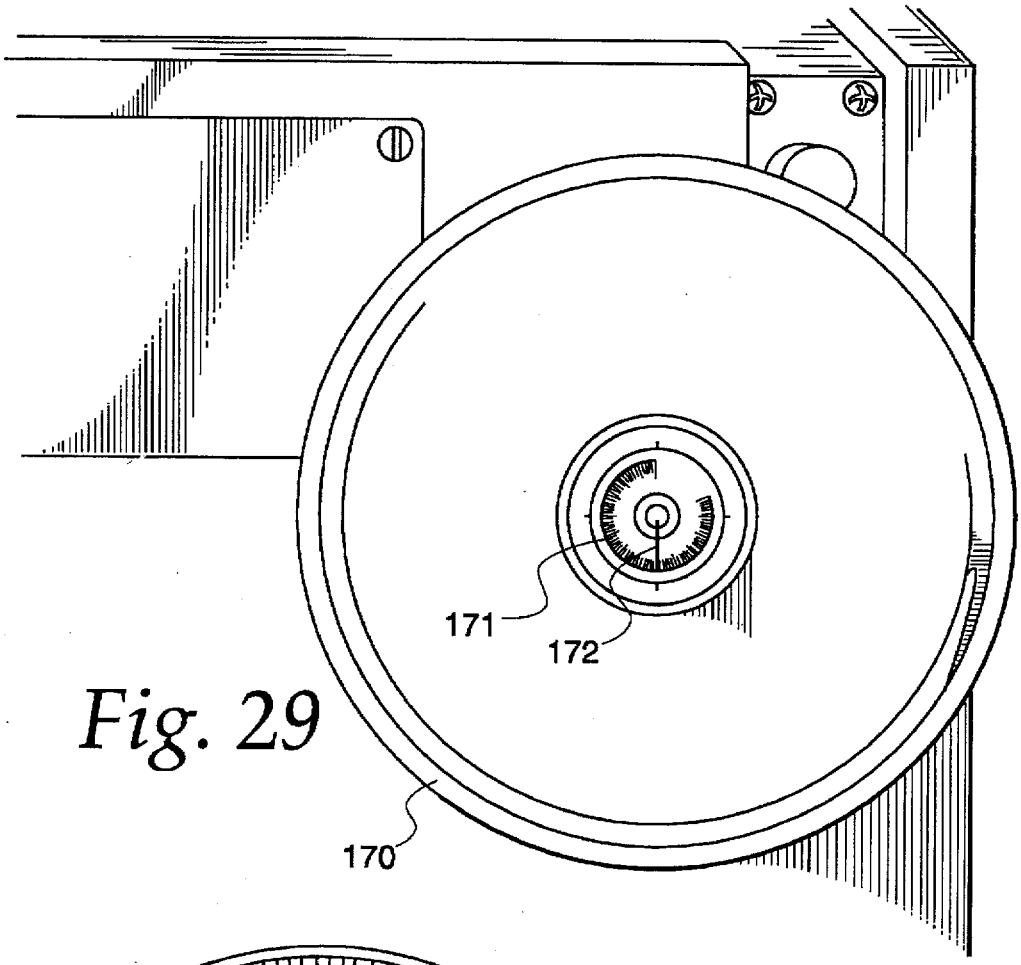
FIG. 29 is a view of a head and foot knife assembly hand wheel scale.

The signature book forms are conveyed by the infeed belt conveyor 38 (FIG. 24) into the space between the upper and lower belts 40 and 40*a*. These belts are brought together to feed the signatures to and against front, bookstops 160 (FIG. 30) which are connected to the rear bookstops 50 (FIG. 26), which will be described hereinafter. At the head and foot trimming stations, there are provided head and foot clamps and head and foot knife blades 44 and 46 (FIGS. 24 and 30). As best seen in FIG. 24, there is a foot clamp assembly 46, which is the left foot clamp assembly 163, as viewed there in FIG. 24, and there is a head clamp assembly 164, which is on the right, as viewed in FIG. 24. Both of these head and foot clamp assemblies are connected together by a common gear and screw assembly such that the respective head and slide assemblies are moved toward or away from each other through equal increments with turning of head and foot, adjustment hand wheel 170 (FIGS. 25 and 29).

In the conventional operation, the operator loosens knife assembly lock-down nuts 168 and 169 (FIG. 26) and then turns the head and foot knife assembly adjustment wheel 170 (FIG. 29) which had associated with it a scale 171 and an indicator 172. The operator would only use the head and foot, hand adjustment scale 171 to the approximate head and foot trim size because the scale and indicator were so inaccurate that they could not be relied upon. Rather than rely on the scale 171, the operator would use a tape measure to measure between the head and foot knives. This measurement was time-consuming during make-ready. The measurement was very difficult to read due the visibility being obstructed by machine parts and hence, could be unreliable and the cause of considerable adjustments in calibrations. The Muller scale 171 operated off rotation of the screw and a considerable amount of wear or backlash could have occurred since the machine was new and the operator could not compensate for wear or backlash between the scale and knife assemblies. The operators would not rely or use the scale 171 except for an approximation and, of course, this approximation resulted in errors and the need for tweaking.

Figure 26:
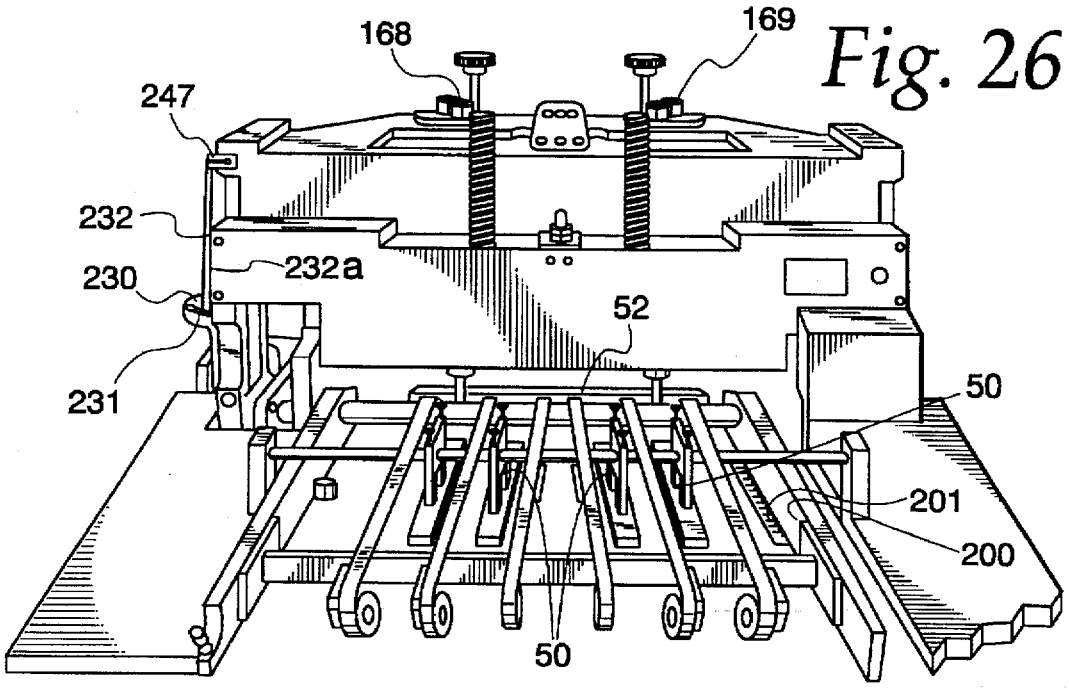
FIG. 26 is a rear view of the trimmer apparatus of FIGS. 24 and 25.
Figure 28:
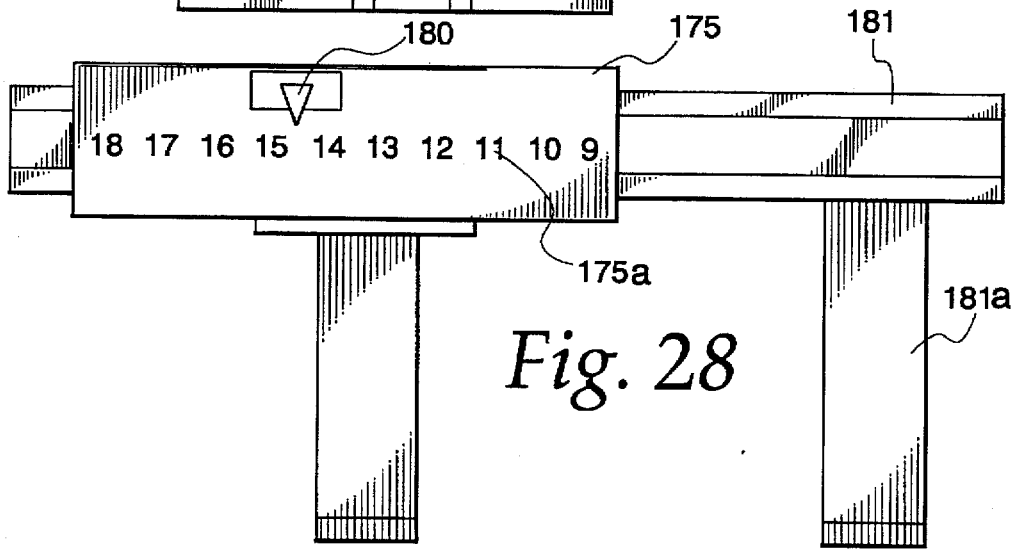
FIG. 28 is a front elevational view of the trimmer head and foot scale and indicator.

In accordance with the present invention, there is provided, as best seen in FIGS. 24 and 28, a head and foot scale 175 which is positioned on a yoke adjacent the top of the head and foot clamp assemblies 163 and 164. The head and foot knives are readily set to the size specified on the data sheet of the job card by first loosening the lock-down nuts 168 and 169 (FIG. 26). Then, the hand adjustment wheel 170 (FIG. 29) is turned to turn the screw and gear assembly to move the knife assemblies until the desired trim length on the data sheet card is indicated on the head and foot scale 175 (FIG. 28). Then, the knife assembly lock-down nuts 168 and 169 are tightened and the assembly is precisely positioned for trimming the head and foot of the sides of the signature.

Figure 27:
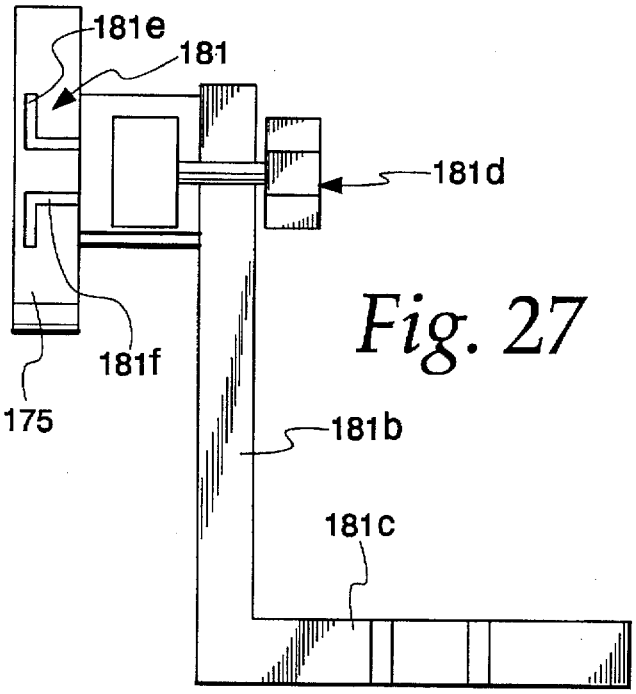
FIG. 27 is a side view of a scale and indicator for the trimmer head and foot.

As best seen in FIG. 28, the preferred head and foot scale 175 is plastic part, which has indicia 175*a* thereon, and which is connected to one of the foot and clamp assemblies 163 and 164 for movement therewith, whereas an indicator or pointer 180 is fixed to a horizontal aluminum rail 181 to be stationary. The rail is supported in a stationary position by trimmer brackets 181*a* which has a vertical leg 181*b*, as shown in FIG. 27, and a horizontal leg 181*c* to be connected to the stationary portion of the machine. The aluminum rail 181 projects laterally out at the top and is secured to the bracket by a bolt and nut assembly 181*d*. The nylon scale 175, as seen in FIG. 27, slides along an upper leg 181*e* and a lower leg 181*f* of the aluminum rail 181. Thus, in this instance, the scale 175 is movable relative to a fixed indicator 180. As before, except that now the setting is for the finished or trimmed size of the book, which can be known and measured leading the particular laps or edges to be trimmed, both at the foot and the head. Thus, the scale 175 is mounted to move directly with the knife assemblies and there is no loss motion by way of backlash as in with using the prior scale which did not work. After making the head and foot cuts, then the booklet is advanced and the face cut knife 52 (FIG. 26) makes the face cut with the book being abutted against face cut stops 50 (FIG. 26) of which there are several. In the conventional Muller trimmer machine, the face cut stops 50 may be adjusted by using a face cut adjustment, knurled knob 191 (FIG. 31) which had a cooperative scale 192. The face cut scale 192 used on the Muller machines was approximate and could not be easily kept in calibration. After a while, the operator would not use this book stop scale 192 because it was too inaccurate due to errors in backlash and also due to the fact that if the knife was sharpened, that the edge of the face cut knife 52 (FIG. 26) could be at different distance than the distance for which the scale 192 (FIG. 31) had been originally calibrated.

Figure 31:
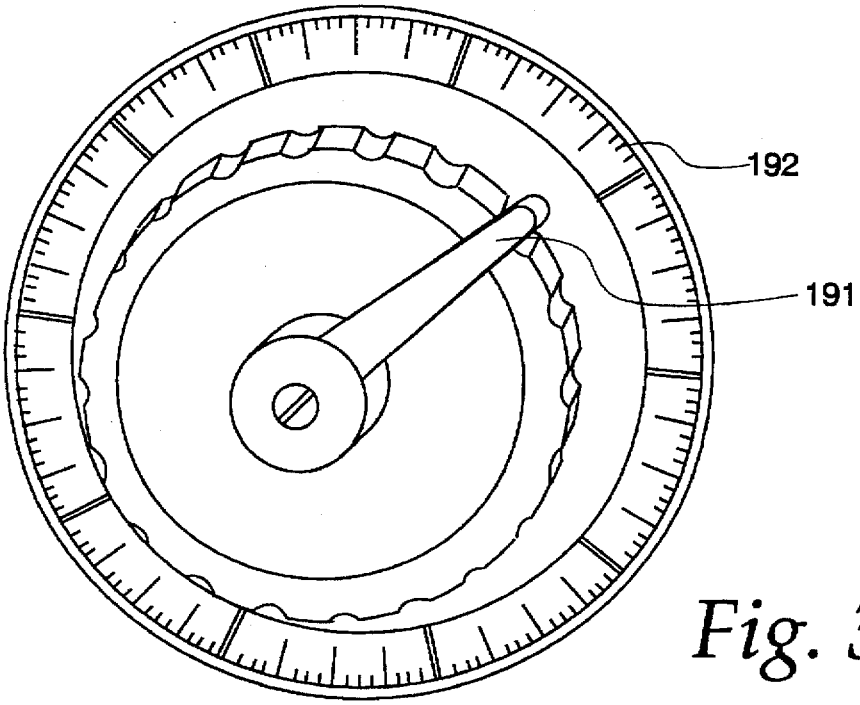
FIG. 31 is an enlarged face cut scale indicator and adjustment handle.
Figure 32:
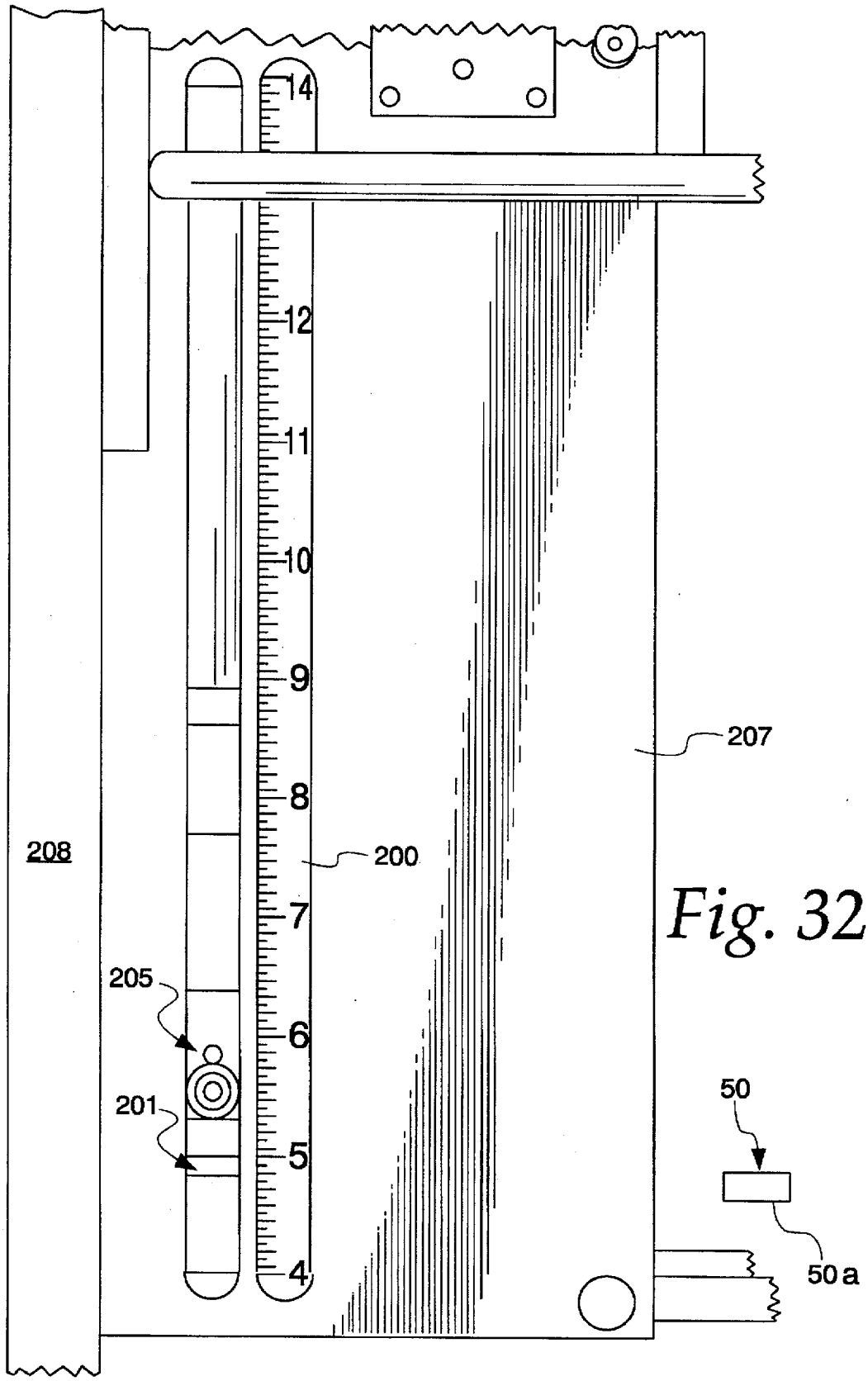
FIG. 32 illustrates a trimmer face cut scale indicator a stop indicator for the scale.
Figure 32A:
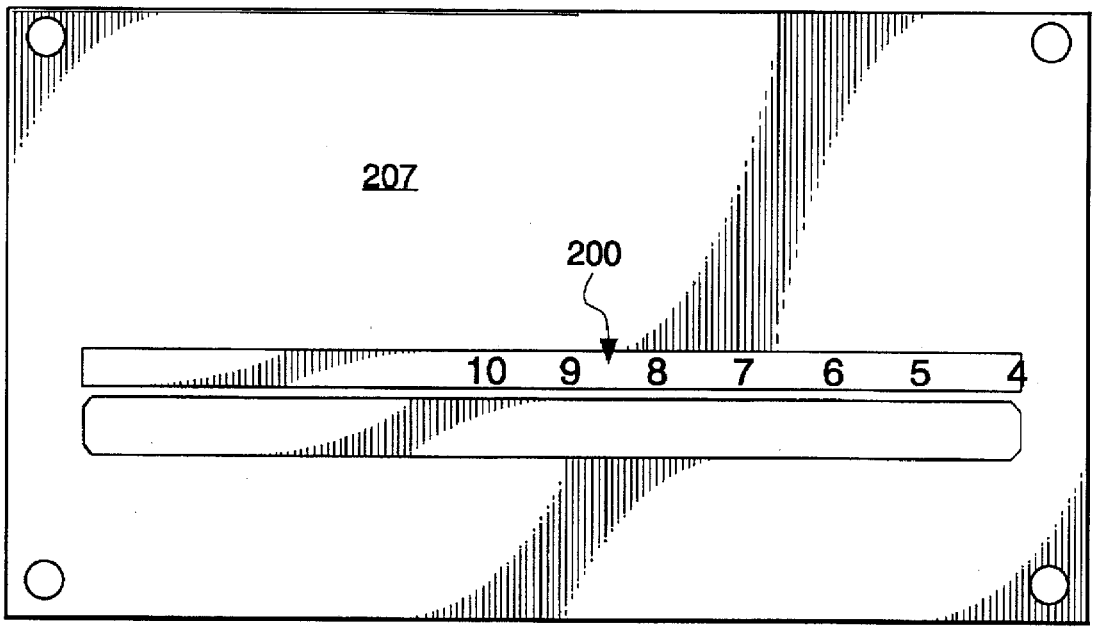
FIG. 32A shows the trimmer face cut scale location.

In accordance with the present invention, there is provided a face cut trimmer scale 200 (FIG. 32) and a movable trimmer face scale indicator 201 which is movable along and indicates the particular location of the forward edges 50*a* of face cut paper stops 50. A plurality of paper stops 50 are mounted on a common bar and this bar is now been provided with an additional stop 205 which carries the indicator pointer 201. This additional stop 205 is mounted on a common bar carrying the paper stops 50 that additional stop 205 moves relative to the indicator scale 200 with stops 50. The indicator scale 200 is located so that it is readily visible at the rear view of the machine as shown in FIG. 26. The indicia on the scale 200 are set at the actual sizes and 1/16th of an inch and they are measured exactly from the knife edge of the face cut knife so that there is no difference due to the particular loss with the change of sharpening of a knife or the like or in backlash between the gear mechanism which is caused when rotating the adjustment face cut knob 191 (FIG. 31). The illustrated and preferred trimmer face cut scale 200 is a small, thin strip which is affixed to a horizontal plate 207 which has been mounted to the trimmer frame 208, as best seen in FIG. 32.

It should be pointed out that the other book stop 160 (FIG. 30) used to stop a following book form during a head and foot trim is carried on a bar or rail 211, which is directly connected to the head stops 50, 205; so that by moving the face cut paper stops 50, 205 to their desired position, for example, at indicia 10 on the scale 200 for a 10" book, causes the stop 160 to be likewise positioned exactly for a 10" book cut.

Figure 18:
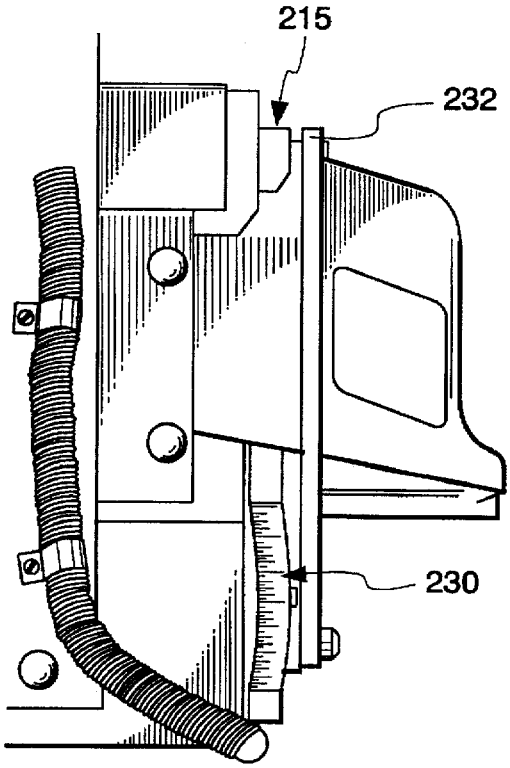
FIG. 18 illustrates a scale associated with the yoke timing of the face cut.
Figure 34:
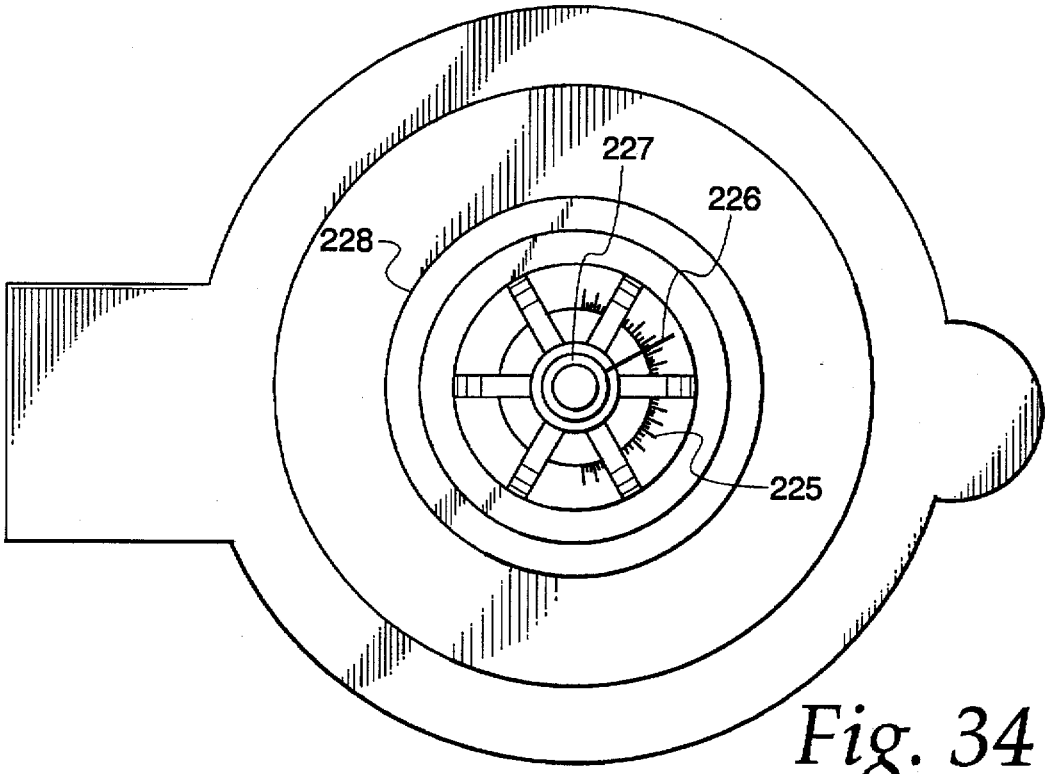
FIG. 34 shows a conventional trimmer face cut adjustment scale and a disconnection coupling for the yoke.

One of the more difficult tasks and one that required considerable amount of tweaking or adjustment was for the operator to adjust the drive or the timing of the yoke 215 (FIG. 18) with the head, foot and face knives thereon to the infeed conveyor 38 (FIG. 24) which had lugs thereon which were pushing the book form toward the stops 160. In a conventional machine, the operator would estimate the amount of drive needed and would readjust until the desired drive was obtained. The Muller machine had a scale 225, as best seen in FIGS. 25 and 34, which cooperated with a scale indicator 226 (FIG. 34). The Muller machine also had a rotatable knob 227 (FIG. 34) which could be turned to connect or disconnect the yoke 215 to the common drive for the lug infeed conveyor 38. There was also a trimmer adjustment hand wheel 228 which was turned, after loosening the connection with rotation of the knob 227, to turn a screw and gear mechanism to adjust the vertical position of the yoke 215 (FIG. 18), and hence, position of the knives thereon relative to the position of the lugs on the timing infeed chains 38 (FIG. 24). The problem was that the screw and gear mechanism for the trimmer drive often became loose and or developed. The scale needed to be recalibrated, but this was very difficult for the operators. The Muller scale suffered in that there was a number of gears which became worn and screw shafts which became worn and there was backlash such that the scale was not measuring accurately and was not used except for approximations. The drive adjustment hand wheel 228 (FIG. 25) was located on the outer side and lower edge of the trimmer a long way from the yoke 215, which was up at the top of the machine and which was at the center portion of the machine rather than at the side where the hand wheel 228 (FIG. 25) is located.

This distance and all of the gear and screw mechanisms in between contributed to the drive adjustment trimmer scale 228 being ineffective. Further, the indicia on the scale 225 were not directly related to the particular size and were really just relative measurements rather than actual related to a particular size or signature.

Figure 35:
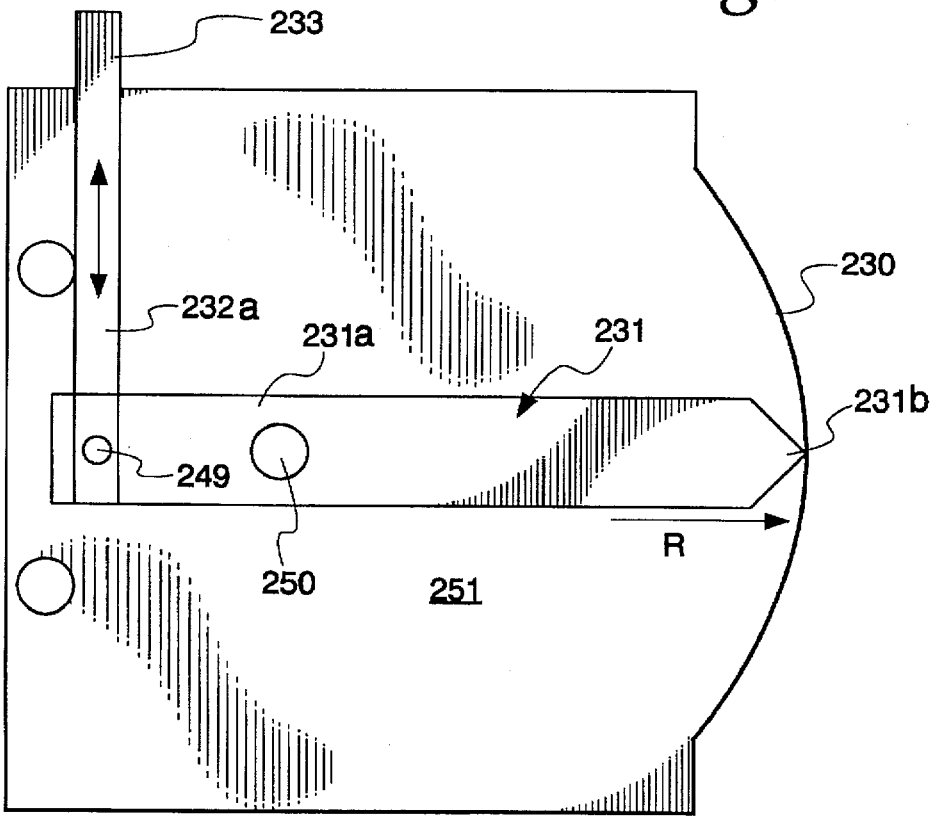
FIG. 35 shows a new trimmer drive scale.
Figure 36:
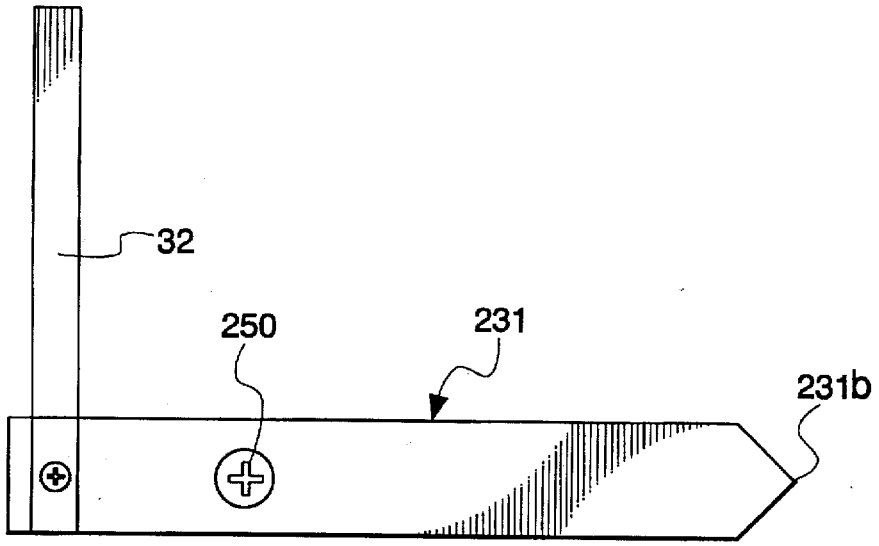
FIG. 36 shows a trimmer drive scale pointer.
Figure 37:
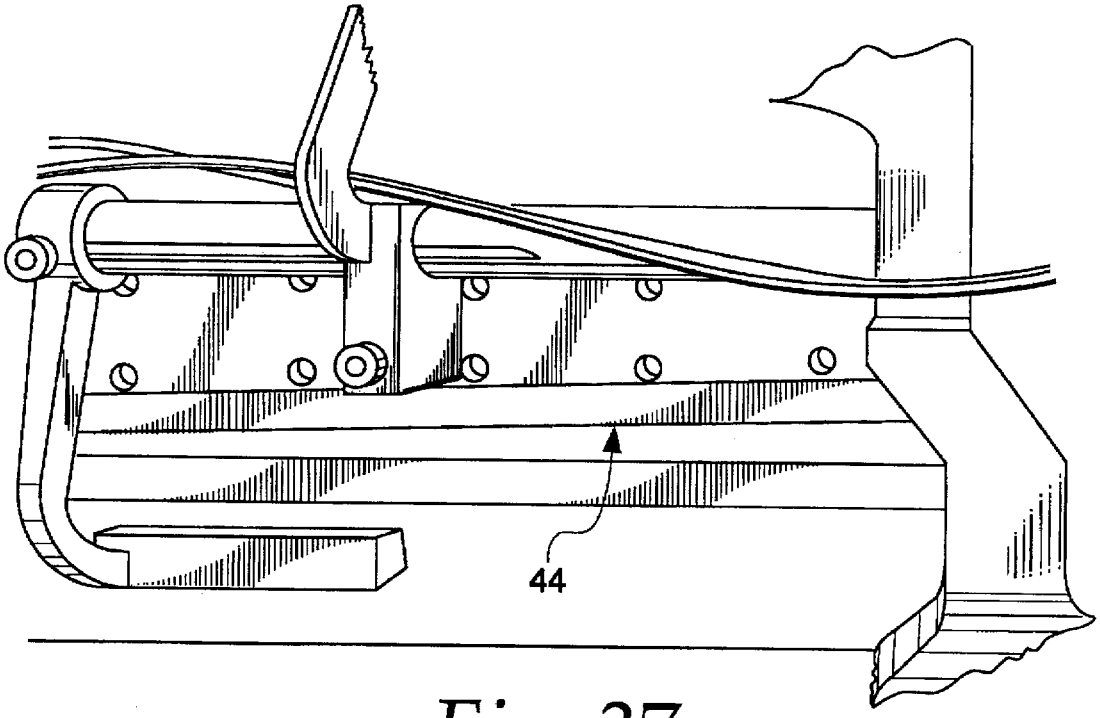
FIG. 37 shows a head and foot shear knife.

In accordance with the present invention, the drive adjustment is obtained quickly and easily and accurately by turning the drive adjustment hand wheel 228 until the measured size, for example, number 10 on a scale 230 (FIGS. 18 and 26), is obtained and by a movable indicator or pointer 231 which is moved by a pusher 232 which is connected to the yoke 215 as shown in FIGS. 26, 35 and 36. As best seen in FIG. 26, the left side of the yoke 215 has a horizontally extending bracket 247 which is connected to the pusher rod 232, which extends downwardly along the side of the yoke and is connected at its lower end 232*a* to an outer end of the pointer 231. More specifically, as best seen in FIG. 35, the pusher 232 moves vertically as indicated by the arrow and it has a pivot pin connection 249 to the end 231*a* of the pointer 231 which has a central stationary pivot 250 fixed to the trimmer frame 251 and mounting the indicator for pivotal movement with the vertical movement of the pusher 232. The pointer has a fine pointed edge 231*b* which moves along and indicates on a arcuate scale 230. As can be seen from FIGS. 18 and 35, the arcuate scale is mounted on a circle or arc having a radius R of 34 inches and is gradated with ¼ inch marks on the scale. The drive scale is calibrated for the particular timing relative to a given signature size.

When the machine is locked out a 100°, the infeed lugs 38*a* are at a known position and the yoke 215 is disconnected and moved vertically to the desired face cut distance as indicated by the pointer 231 on the scale 230. At this vertical position, the knives and yoke will be at a height related to the lugs on the infeed conveyor 38 such that the signatures will abut against the head and foot stop 160 and with the preceding signature being with its folded edge abutting against the face cut stops 50. The mathematics are such that the scale and the drive are directly related to the measured size using the vertical displacement of the yoke to pivot indicator 230 through a distance related proportionally to the size of the trim, which in this example, because of the particular machine, is on a 34-inch radius with a quarter inch marks on the scale. Herein, the yoke had a 3.25 inch stroke and the lever pointer is 5.76 inches in length from the pivot axis 250 to the point 231*b*. The 3.25 stroke was projected out to be 5.43 and this was laid out on arcuate surface 230 (FIG. 18) which arcuate surface is cut at a 34-inch radius. In any event, the mathematics are used to provide a scale 230 wherein the actual book length, e.g., 10 inches can be set at an indicia 10 on the scale 230 and the yoke will be adjusted proportionally in the vertical direction a proportional portion of its total stroke, to give a 10-inch trimmed book form length upon completion of its cutting stroke. If the pointer is moved to a 9-inch indicia on the scale 230, then the yoke is also moved proportionally in the vertical direction that upon completion of its downward stroke it will have severed a 9-inch trimmed book form. Thus, the operator is able to set the particular drive scale indicator and yoke using the drive adjustment hand wheel 228 and generally ignoring the Muller scale 225. This eliminates much of the operator error which was caused when trying to rely on an inaccurate Muller scale 225.

While the preferred embodiment described above is a saddle bindery machine, the invention is applicable to other bindery apparatus such as the perfect bindery apparatus. For either of these kinds of bindery apparatus, it will be seen from the foregoing that the scales provide objective measurements by which to collect and store data from a previous operation onto job cards which then can be used to provide a proper machine set up at a later date. The objective is to provide a machine which when it takes the same job again, operates as if it was continuing the first job as it was first run. The invention allows reduction of the initial set up time, e.g., from 12 hours to 43 minutes and a reduction of the initial production run time from e.g., as many as 8 hours of initial production runs and tweaking to about one hour. Another objective is to allow the operator and the several team members to make adjustments and set up the machines without having to jog and to do much of the work while a previous job is running or whenever the machine is available. By the use of extensive detailed plan and make ready, each task may be assigned to a different person and then each of the persons may be make their objective measurements and the positioning of their parts while the machine is locked out at 100° which is the reference point without having to do any substantial jogging as the was the practice heretofore.

The present invention allows the operator to make adjustments and set up the signature conveyors without having to jog the machine. The operator resets the conveyor projections in the form of upstanding pins or upstanding lugs from the old positions to the new positions.

While the scales indicia, illustrated in the above-described preferred embodiment of the invention, are stationary scales located at their respective positions on their respective pieces of apparatus, it is to be understood that, while the bindery apparatus is locked out at a reference position, stepper motors or the like may be attached to the piece to be adjusted and operated to do the adjusting step mechanically rather than manually. Also, the scales and indicia might be in the form of remote digital readouts. Thus, it will be seen that the make-ready of the present invention may be done manually, as described above, or by using motors, computers and digital readout devices.

What is claimed is:

1. In a bindery apparatus for supporting and conveying signatures for collation and through a securing station and for securing ends of the collated signatures into a book form, said apparatus comprising:

a slide surface extending longitudinally along a number of pocket feeding stations and, through a fixing station, for supporting the signatures as they are slid along the slide surface;

a gathering conveyor extending along the slide surface for gathering signatures and having a projection to abut trailing ends of signatures dropped onto the slide surface from a series of signature feeding machines to make a book form;

a second conveyor extending along the slide surface and having projections for conveying the signatures collated into a book form from the gathering conveyor and for moving the book forms along the slide surface;

a common power drive for driving the gathering conveyor and for driving the second conveyor;

means to connect or disconnect each of the gathering and second conveyors to the common power drive at a reference point;

indicia related to the size of the signature associated with the position of the projections on the respective gathering and second conveyors for use upon a disconnection of said conveyors from the common power drive and movement of the respective projections to positions at the indicia for the size of signature to be conveyed while the conveyors are at the reference point and before reconnection of said conveyors to the common power drive.

2. The bindery apparatus of claim 1 wherein the slide surface is a raceway with the signatures laying flat on the raceway; and a bindery for the book forms includes a cutter to cut spines from the book form and includes an adhesive applicator to apply adhesive to the cut ends of the book forms.

3. The bindery apparatus of claim 1 wherein the slide surface is a V-shaped saddle, and folded signatures are in open V-shape when sliding along the saddle; and a trimmer station is provided for trimming laps from the book forms.

4. A saddle and conveyor apparatus for supporting and conveying signatures for collation and through a station for securing the collated signatures into a book form, said apparatus comprising:

a saddle extending longitudinally along a number of pocket feeding stations and, through a fixing station, for supporting the signatures with opposite sides of the signature being disposed on opposite sides of the saddle;

a gathering conveyor extending along the saddle for gathering signatures and having a lug to abut trailing ends of signatures dropped onto the saddle from a series of signature feeding machines;

a second conveyor extending along the saddle and having lugs for conveying the signatures collated into a book form from the gathering conveyor and for moving the book forms along the saddle;

a common power drive for driving the gathering conveyor and for driving the second conveyor to convey the signatures;

means to connect or disconnect each of the gathering and second conveyors to the common power drive;

indicia related to the size of the signature associated with the position of lugs on the respective gathering and second conveyors for use upon a disconnection of said conveyors from the common power drive and movement of the respective lugs to positions at the indicia for the size of signature to be conveyed before reconnection of said conveyors to the common power drive.

5. An apparatus in accordance with claim 4 wherein a first scale is associated with the lugs on the gathering chain conveyor with indicia thereon related to signature size; and a second scale is associated with the second conveyor lugs on the second conveyor and related to signature size.

6. An apparatus in accordance with claim 5 wherein the scales are linear and extend in a direction parallel to the direction of conveyor travel.

7. An apparatus in accordance with claim 6 wherein each scale is a half scale so that a numeral indicia thereon locates the conveyor lug at a distance which is one-half of the length of the signature.

8. An apparatus in accordance with claim 4 including a transfer conveyor located between the gathering conveyor and the second conveyor and having a lug thereon; and a scale with indicia thereon associated with the length of the signature to allow setting of the conveyor lug to a size indicia on the transfer conveyor scale.

9. An apparatus in accordance with claim 4 wherein a stitcher head is provided at the fixing station to form staples in the fold of a book form; and a scale is provided alongside the stitcher heads to position the heads at desired staple locations on the book form of a known length.

10. A method for making ready a gathering conveyor and a book form conveyor for conveying signatures and book forms along a slide surface of a bindery apparatus, said method comprising the steps of:

locking out the gathering conveyor and the book form conveyor at a specific reference point for a common line, power drive;

providing a length measurement for the signatures to be collated and fixed into a book form;

disconnecting the second conveyor from a common line, power drive while under lock-out and shifting the conveyor projections to positions related to indicia indicating the length measure;

reconnecting the second conveyor to the common line, power drive with the projections repositioned for the new signature length;

disconnecting the gathering conveyor from the common line, power drive while under a lock-out and shifting conveyor projections thereon to positions related to indicia for the new signature length thereby making ready the conveyors for timed movement of the conveyor projections to pocket feeding stations and to each other.

11. A method in accordance with claim 10 wherein the steps of shifting the conveyor projections for the gathering and second conveyors comprises the additional steps of operating motors and having digital readouts at remote locations that provide the indicia.

12. A method in accordance with claim 11 including the steps of:

providing a first scale alongside the gathering conveyor having numerals thereon related to the length of a signature; and providing a second scale alongside the second conveyor having numerals thereon related to the length of a signature.

13. A method in accordance with claim 12 including the step of transferring book forms with a transfer conveyor between the gathering conveyor and the second conveyor; and using indicia associated with the length of the book form to reposition projections on the transfer chain to time the transfer lugs to the projections on the gathering and second conveyors.

14. A method in accordance with claim 13 including the steps of:

providing a transfer scale with indicia thereon extending in the direction of signature travel; and moving the transfer projection parallel to the scale to align its pushing edge with a size indicia on the scale.

15. A method in accordance with claim 13 including a stitcher head located at a stitcher station and the steps of:

positioning stitcher heads using indicia on a scale located adjacent the stitcher; and having indicia related to the length of the book forms being stitched.

* * * * *